US011987406B2

(12) United States Patent
Magri et al.

(10) Patent No.: US 11,987,406 B2
(45) Date of Patent: May 21, 2024

(54) MACHINE FOR STABILISING PALLETISED LOADS WITH REEL CHANGE SYSTEM

(71) Applicant: A.C.M.I.—SOCIETA' PER AZIONI, Fornovo di Taro (IT)

(72) Inventors: Giacomo Magri, Beduzzo (IT); Giorgio Oppici, Rubbiano di Solignano (IT)

(73) Assignee: A.C.M.I.—SOCIETA' PER AZIONI, Fornovo di Taro (IT)

( * ) Notice: Subject to any disclaimer, the term of this patent is extended or adjusted under 35 U.S.C. 154(b) by 0 days.

(21) Appl. No.: 17/736,301

(22) Filed: May 4, 2022

(65) Prior Publication Data

US 2022/0355958 A1 Nov. 10, 2022

(30) Foreign Application Priority Data

May 7, 2021 (IT) ..... 102021000011720

(51) Int. Cl.
*B65B 11/04* (2006.01)
*B65B 11/00* (2006.01)
(Continued)

(52) U.S. Cl.
CPC ..... *B65B 11/045* (2013.01); *B65B 11/585* (2013.01); *B65B 41/16* (2013.01);
(Continued)

(58) Field of Classification Search
CPC ... B65B 11/025; B65B 11/045; B65B 11/585; B65B 41/16; B65B 61/06; B65B 2011/002; B65B 2210/14
(Continued)

(56) References Cited

U.S. PATENT DOCUMENTS 4,204,377 A * 5/1980 Lancaster et al. .... B65B 11/045 53/399
5,016,427 A * 5/1991 Thimon et al. ..... B65B 41/16 53/399
(Continued)

FOREIGN PATENT DOCUMENTS

CN 212711922 U 3/2021
EP 0220712 A1 * 5/1987 ..... B65B 11/025
(Continued)

*Primary Examiner* — Stephen F. Gerrity
(74) *Attorney, Agent, or Firm* — Browdy and Neimark, PLLC

(57) ABSTRACT

Machine for stabilising palletised loads includes a functional arrangement, a first movement apparatus generating relative motion about a revolution axis, a second movement apparatus generating relative translation motion of the functional arrangement in a direction parallel to the revolution axis. The functional arrangement includes a support shaft, a motorised drive roller, a contrast roller, and actuator members to create relative movement between the drive roller and the contrast roller in transversal direction with respect to the respective rotation axes between a distanced configuration, in which a gap is defined between the drive roller and the contrast roller to be crossed with clearance by the covering tape unwinding from the reel, and a neared configuration, in which the drive and contrast rollers clamp the covering tape. The support shaft and the contrast and/or drive rollers are mounted on the functional arrangement and oriented in the same direction.

16 Claims, 11 Drawing Sheets

(51) Int. Cl.

| | |
|---|---|
| ***B65B 11/02*** | (2006.01) |
| ***B65B 11/58*** | (2006.01) |
| ***B65B 41/16*** | (2006.01) |
| ***B65B 61/06*** | (2006.01) |

(52) U.S. Cl.
CPC ..... *B65B 61/06* (2013.01); *B65B 2011/002* (2013.01); *B65B 11/025* (2013.01); *B65B 2210/14* (2013.01)

(58) Field of Classification Search
USPC ..... 53/556, 587, 389.3, 389.4
See application file for complete search history.

(56) References Cited

U.S. PATENT DOCUMENTS 5,103,621 A * 4/1992 Matsumoto ..... B65B 11/045 53/556
5,149,004 A 9/1992 Sudau et al.
5,408,808 A * 4/1995 Masuda et al. ..... B65B 11/045 53/556
5,570,564 A * 11/1996 Moore et al. ..... B65B 11/045 53/389.2
5,836,140 A * 11/1998 Lancaster, III ..... B65B 11/045 53/64
2005/0193687 A1 9/2005 Tosa
2006/0130437 A1* 6/2006 Tosa ..... B65B 11/00 53/556
2006/0254225 A1 11/2006 Lancaster et al.
2010/0025517 A1* 2/2010 Cere ..... B65B 11/025 242/559.1
2011/0030317 A1* 2/2011 Murarotto ..... B65B 11/045 53/399
2017/0101205 A1* 4/2017 Schieck et al. ..... B65B 11/025
2020/0407089 A1 12/2020 Jones
2021/0086926 A1* 3/2021 Mustonen et al. .... B65B 11/025
2022/0169407 A1* 6/2022 Magri et al. ..... B65B 11/045

FOREIGN PATENT DOCUMENTS

EP 0426308 A1 * 5/1991 ..... B65B 11/045
EP 0845412 A1 6/1998
KR 20110118950 A 11/2011
WO 2008059359 A2 5/2008

* cited by examiner

MACHINE FOR STABILISING PALLETISED LOADS WITH REEL CHANGE SYSTEM

TECHNICAL FIELD

The present invention relates to a machine for stabilising palletised loads, i.e. for stably blocking one or more loads (objects) above a pallet.

BACKGROUND

As is well known, a palletised load generally comprises a pallet, for example made of wood, plastic or other material, and one or more loads arranged on top of said pallet.

A currently very common way for stabilising palletised loads is to wrap them with a stretch film tape.

In practice, the stretch film tape is unwound from a reel and, after being subjected to an elongation step, conventionally called pre-stretch, is wound as a spiral around the palletised load, so as to form a complete wrapping.

But the stretch film is commonly made of polymeric material and consequently has a high environmental impact.

For the environmental impact connected to the stabilisation of palletised loads to be reduced, it has been proposed to replace the stretch film tape with a covering tape made of recyclable and/or biodegradable material, for example a cellulose-based material like paper.

A machine capable of performing this procedure is fully described in the Italian patent application No. 102020000029396 filed on behalf of the same applicant.

The machine in question generally comprises:

- a functional arrangement (also called head),
- a first movement apparatus adapted to generate a relative motion of revolution of the functional arrangement around the palletised load, according to a predetermined revolution axis, and
- a second movement apparatus adapted to generate a relative motion of translation of the functional arrangement with respect to the palletised load in a direction parallel to the revolution axis.

The functional arrangement comprises first of all a support shaft to which a reel of covering tape is associated, which is adapted to rotate on itself around the central axis of the support shaft.

The functional arrangement further comprises an advancement device which, at the beginning of each winding step, is adapted to make the free end of the covering tape advance, unwinding it from the reel, along a predetermined advancement direction, so that said free end can project outside the functional arrangement and be seized by a gripping device which makes it integral with the palletised load.

In this way, thanks to the subsequent combination of the relative motion of revolution and the relative motion translation of the functional arrangement with respect to the palletised load, the covering tape is unwound from the reel and wound around the palletised load.

Downstream of the advancement device, the functional arrangement also comprises a cutting device which, at the end of the winding, is adapted to cut the covering tape, separating the segment wound on the palletised load from the one still wound on the reel.

Then, the advancement device installed on the functional arrangement is put back into operation, so that the new free end of the covering tape can project and the operations outlined above can be repeated on another palletised load to be stabilised.

The aforesaid advancement device normally comprises a pair of rollers having rotation axes parallel to the central axis of the support shaft of the reel, of which a motorised drive roller and an idly rotatable contrast roller.

These rollers are associated to actuator members adapted to drive them in a relative movement in transversal direction (with respect to the respective rotation axes), between a distanced configuration, in which the drive roller and the contrast roller define a gap adapted to be crossed with clearance by the covering tape unwinding from the reel, and a neared configuration, in which the drive roller and the contrast roller are adapted to clamp the covering tape in vice.

In this way, when it is necessary to make the free end of the covering tape advance, the rollers are brought into neared configuration and the drive roller is put into rotation.

A limitation of this solution, however, is that the reel of covering tape must be relatively small in size in order to contain the weight and inertia of the functional arrangement which would otherwise complicate the movement apparatuses considerably and make it difficult to control, especially at high speeds.

This means that each reel of covering tape is capable of wrapping a fairly limited number of palletised loads and must be replaced fairly frequently.

DISCLOSURE OF THE INVENTION

In view of the foregoing, it is an object of the present invention to make available a machine for stabilising palletised loads which allows a rapid replacement of the reel of covering tape by means of simple and easily automated operations.

These and other objects are reached thanks to the characteristics of the invention as set forth in the independent claims. The dependent claims outline preferred and/or particularly advantageous aspects of the invention but not strictly necessary for the implementation thereof.

In particular, an embodiment of the present invention makes available a machine for stabilising palletised loads, comprising:

- a functional arrangement,
- a first movement apparatus adapted to generate a relative motion of revolution of the functional arrangement around the palletised load according to a predetermined revolution axis,
- a second movement apparatus adapted to generate a relative motion of translation of the functional arrangement with respect to the palletised load in a direction parallel to the revolution axis, wherein the functional arrangement comprises at least:

- a support shaft having a predetermined central axis and adapted to coaxially receive a reel of a covering tape,
- a motorised drive roller having a rotation axis parallel to the central axis of the support shaft,
- a contrast roller having a rotation axis parallel to the rotation axis of the drive roller, and actuator members adapted to create a relative movement of said drive roll-er and said contrast roller in transversal direction with respect to the respective rotation axes between a distanced configuration, in which, between the drive roller and the contrast roller, a gap is defined, adapted to be crossed with clearance by the covering tape unwinding from the reel, and a neared configuration, in which the drive roller and the contrast roller are adapted to clamp (grip) said covering tape, and wherein the support shaft and at least one between the contrast roller and the drive roller are mounted cantilevered on the functional arrangement and are oriented in the same direction.

In practice, the support shaft and at least one between the contrast roller and the drive roller each have two axial ends, only one of which is physically connected to the functional arrangement, for example coupled to a structural part thereof, while the second and opposite axial end is completely free.

The fact that they are oriented in the same direction then means that said support shaft and said at least one between the contrast roller and the drive roller extend, starting from the respective end constrained to the respective free end, in parallel and equally oriented directions.

In this way, a reel of covering tape can be coupled to the functional arrangement extremely easily and quickly, without the need for complex operations.

In fact, by means of a simple relative translation movement in a direction parallel to the central axis of the support shaft, it is advantageously possible to fit the latter coaxially inside the reel and, at the same time, it is possible to insert the free end of the covering tape laterally into the gap defined between the drive roller and the contrast roller which are in an open configuration.

After this operation, the drive roller and the contrast roller can then be brought into a neared configuration, in order to clamp the free end of the covering tape and consequently begin a winding step.

By virtue of this simplicity, the entire process lends itself to being carried out completely automatically.

For example, it is possible to arrange a magazine capable of accommodating a reel with the covering tape already partially unwound, while keeping the free end of said covering tape parallel to the axis of the reel, for example vertically.

By means of the movement means of the machine, the functional arrangement can then be brought at the aforesaid magazine and oriented so that the support shaft is coaxial with the reel and the gap between the drive roller and the contrast roller is aligned with the free end of the covering tape.

At this point, again by means of the movement means, the functional arrangement can be made to translate in a direction parallel to the axis of the support shaft, until the reel is fitted on the support shaft and the free end of the covering tape is fitted inside the gap between the drive roller and the contrast roller.

According to an aspect of the invention, the contrast roller may be axially subdivided into a plurality of cylindrical sections, mutually coaxial and aligned along the rotation axis.

In this way, each cylindrical section can act on a respective portion of the covering tape unwinding from the reel, avoiding that small differences in tension between these portions can cause the covering tape to creep with respect to the contrast roller.

Another aspect of the invention provides that the cylindrical sections of the contrast roller may be interspersed with one or more guide prongs, which are mutually parallel to and radially projecting with respect to said cylindrical sections.

These guide prongs have the function of directing the free end of the covering tape unwinding from the reel towards a suitable direction, for example towards a possible cutting device.

According to a different aspect of the invention, the drive roller may be mounted on the functional arrangement in a fixed position, and the actuator members actuating the movement between the distanced configuration to the neared configuration may be adapted to move the contrast roller transversely with respect to the drive roller.

In this way, it is advantageously possible to simplify the mechanics of the functional arrangement, since the actuator members of the contrast roller can be completely independent of the driving members that are adapted to put the drive roller in rotation.

According to another aspect of the invention, the support shaft for the reel may be a rotatable shaft adapted to rotate on board the functional arrangement about its central axis.

Thanks to this solution, the reel can be firmly blocked to the support shaft without preventing it from rotating during its unwinding and its application to the palletised load.

In this respect, the support shaft may for example be an expandable shaft, i.e., a shaft provided with movable elements capable of varying the diameter between a maximum and a minimum value.

In this way, the reel can be fitted onto the support shaft, when the same is in the minimum diameter configuration, after which, bringing the support shaft towards the maximum diameter configuration, it is advantageously possible to make it integral with the reel.

According to another aspect of the invention, the functional arrangement may comprise a motor for putting the support shaft in rotation.

The function of this motor is to facilitate the unwinding of the covering tape during the stabilisation of palletised loads.

According to a different aspect of the invention, the functional arrangement may further comprise a cutting device for separating the covering tape from the reel, which is positioned so that the drive roller and the contrast roller are operatively interposed between the support shaft and said cutting device.

As mentioned above, this cutting device has the function, at the end of each winding operation, of separating the segment of covering tape wound around the palletised load from that still wound on the reel on board the functional arrangement.

For example, the cutting device may comprise at least:

a blade, a blocking device operatively positioned between the blade and the support shaft, to selectively block the covering tape unwinding from the reel, and actuator members adapted to move said blade transversely with respect to the covering tape.

This embodiment provides a particularly simple and reliable solution for implementing the cutting device.

In particular, the blocking device may comprise a pair of plates and actuator members adapted to create a relative movement of said plates between a distanced configuration, in which the covering tape passes with clearance between said plates, and a neared configuration, in which the covering tape is tightened between said plates.

In addition to blocking the covering tape during the cutting operations, these plates also allow the free end of the covering tape to be properly guided while advancing.

Another aspect of the invention provides that the functional arrangement may further comprise:

a first return roller operatively arranged between the drive roller and the support shaft, a second return roller, mounted cantilevered on the functional arrangement, which is operatively arranged between the drive roller and the first return roller, and actuator members adapted to move the second return roller between a disengagement position, in which the axis of the second return roller is located on one side of an imaginary plane containing the rotation axis of the drive roller and the axis of the first return roller, and an engagement position, in which the axis of the second return roller is located on the opposite side of said imaginary plane.

In this way, the second return roller in the disengagement position does not hinder the mounting of the reel and of the free end of the covering tape on the functional arrangement, although it allows, when brought into the engagement position, to guide the covering tape in a more or less tortuous path, in order to be able to adjust the tension thereof during the winding and stabilisation of the palletised loads.

Moving on to other aspects of the machine, the latter can further comprise:

- a gripping device adapted to take a first free end of the covering tape wound on the reel and to make it integral with the palletised load, and
- a fixing device adapted to fix at least a second free end of the covering tape (obtained, for example, as a result of cutting operations) to the palletised load.

In this way it is possible to achieve a stable and safe wrapping of the palletised load with the covering tape.

According to an aspect of the invention, the machine can comprise a rest platform for the palletised load and an upper pad, superimposed on said rest platform and which is adapted to stay in contact with the top of the palletised load.

In this way, during the winding steps, the palletised load is stably retained between the pad and the rest platform, preventing the lateral thrusts generated by the winding of the covering tape from causing displacements and possible falls of the load.

The pad can simply be placed on the top of the palletised load or it can be pressed with a certain force towards the rest platform.

In this context, the first movement apparatus may comprise actuator members adapted to put said rest platform in rotation around a rotation axis coincident with the revolution axis.

Thanks to this solution, the revolution movement of the functional arrangement is obtained indirectly, i.e. it is the palletised load which, being put in rotation by the platform, rotates on itself, while the functional arrangement remains substantially stationary in a predetermined position.

In this way, the aforesaid revolution movement is actuated quite simply.

In this context, the upper pad could simply be dragged into rotation by the palletised load with which it is in direct contact.

More preferably, the first movement apparatus can however comprise further actuator members adapted to put the upper pad in rotation around a rotation axis coincident with the revolution axis.

This prevents the palletised load, especially when defined by a stack of separate objects, from being able to be twisted and possibly from losing stability, especially during the initial acceleration step.

Another aspect of the invention provides that the machine may also comprise lifting members adapted to bring the upper pad closer to and away from the rest platform along a direction parallel to the revolution axis.

Thanks to these lifting members, the machine can be advantageously adjusted to be used with palletised loads of different heights, furthermore the upper pad can possibly be pressed with a certain force towards the rest platform.

According to another aspect of the invention, the second movement apparatus can be configured to allow a variation in the orientation of the functional arrangement by rotation around an oscillation axis perpendicular to the revolution axis.

Thanks to this solution, the reel (which is installed in the functional arrangement) can be oriented so that the rotation axis thereof is always perpendicular to the direction, typically spiral-like, with which the covering tape winds the palletised load following the joint action of the revolution movement and the translational movement of the functional arrangement, avoiding the onset of transversal tensions which, especially in the case of an inextensible tape, could cause tearing or obtaining a winding that is not perfectly adherent to the palletised load.

In this context, the second movement apparatus can comprise a serial manipulator, preferably with five or six axes, to whose terminal the functional arrangement is fixed.

This serial manipulator represents a particularly robust, efficient and reliable solution for moving the reel and all the other devices associated with the rigid frame in the space surrounding the palletised load.

Alternatively, the second movement apparatus can comprise:

- a supporting column,
- a carriage slidingly associated with said supporting column in a direction parallel to the revolution axis,
- an articulated arm with parallel axes having a first end articulated to the carriage, and
- an articulated joint adapted to connect the functional arrangement to the second end of the articulated arm, defining an articulation axis coincident with the oscillation axis.

In this way, the second movement apparatus is substantially configured as a SCARA-type robot, generally cheaper and simpler than a serial manipulator, but which, thanks to the presence of the articulated joint, is also able to orient the reel with respect to the oscillation axis mentioned above.

As mentioned above, an aspect of the invention provides that the machine may comprise a magazine adapted to support a reel of covering tape in a predetermined orientation, for example so that its axis is vertical, and to support a first end of said covering tape at least partially unwound from the reel according to an orientation parallel to the axis.

Thanks to this solution, while the machine is using a reel on board the functional arrangement, a second reel can be prepared in this magazine, from where it can be taken by the functional arrangement automatically when the first reel is finished.

According to another aspect of the invention, the covering tape may consist of a cellulose-based material such as paper.

In this way, the stabilisation of palletised loads takes place with a reduced environmental impact compared to traditional solutions that use plastic stretch film.

BRIEF DESCRIPTION OF THE FIGURES

Further characteristics and advantages of the invention will become clear from reading the following description provided by way of non-limiting example, with the aid of the figures illustrated in the accompanying tables.

DETAILED DESCRIPTION

Figure 1:
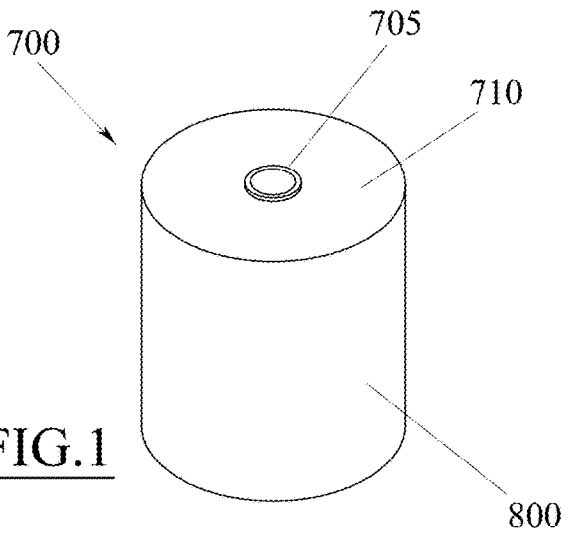
FIG. 1 is an axonometric view of a reel of covering tape adapted to be mounted on the functional arrangement of a machine for stabilising palletised loads.
Figure 2:
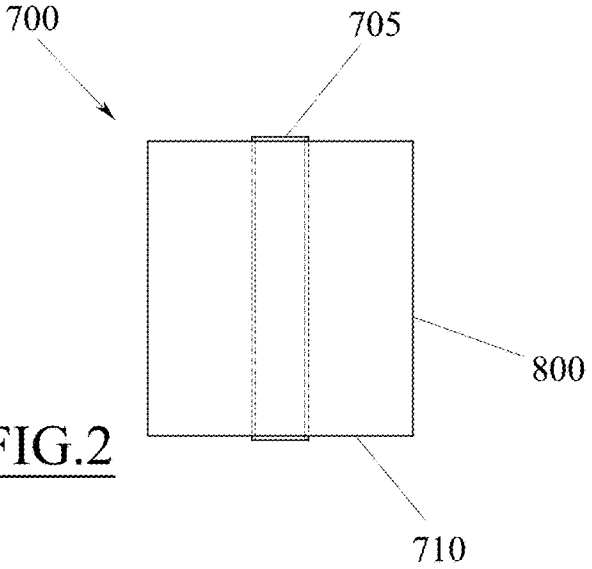
FIG. 2 is a side view of the reel of FIG. 1.
Figure 3:
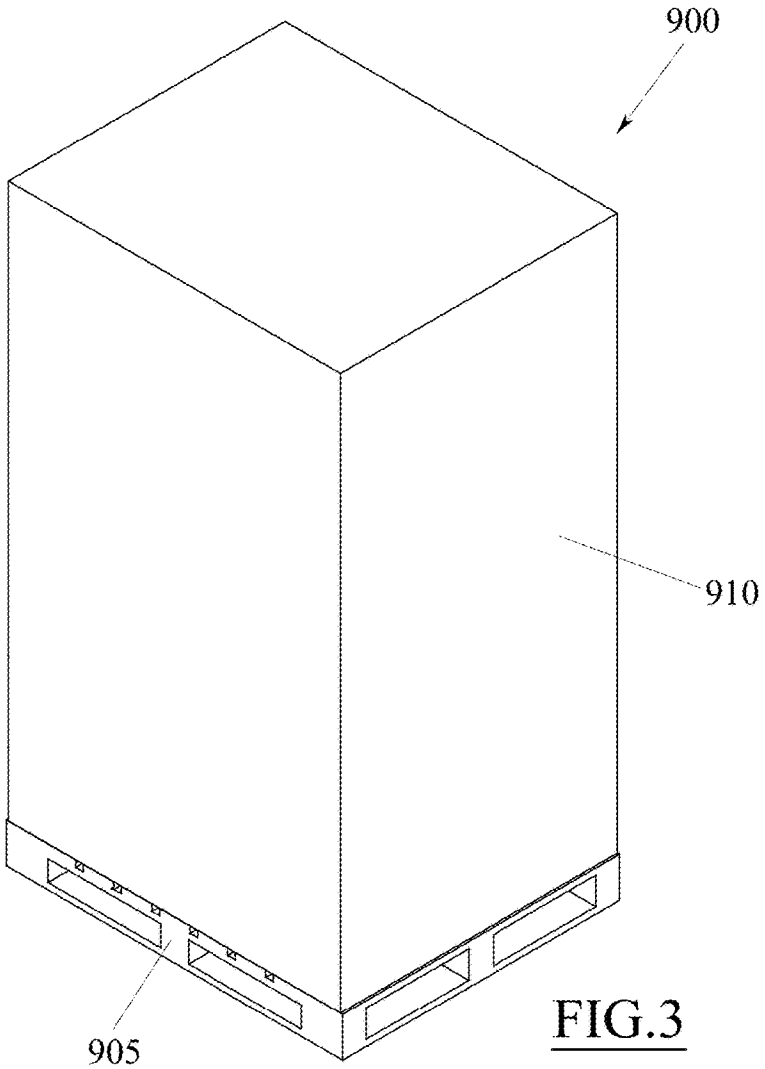
FIG. 3 is an axonometric and schematic view of a palletised load.

With the aid of the above figures, a machine 100 for stabilising palletised loads 900 is described.

A palletised load 900 generally comprises a pallet 905, for example made of wood, plastic, metal or other material, and one or more loads 910 stacked on top of said pallet 905.

Each load 910 can in turn be composed of one or more objects, such as for example an arrangement of bottles or other containers joined together to form a bundle.

The stabilisation of the palletised loads 900 is achieved by wrapping with a covering tape 800.

This covering tape 800 can be made of a cellulose-based material, for example paper, or of any other recyclable and/or biodegradable and/or compostable material.

By virtue of its nature, the covering tape 800 may therefore be generally inextensible.

The covering tape 800 may be folded in an appropriately sized reel 700.

In particular, said reel 700 may comprise a tubular support 705, preferably cylindrical, on which the covering tape 800 is wound so as to form a roll 710.

The axis of this roll 710, i.e., the winding axis of the covering tape 800 around the tubular support 705, is generally coincident with the axis of the tubular support 705.

The tubular support 705 may be made of cardboard, metal, plastic or any other suitable material.

Turning to the machine 100, it comprises first of all a functional arrangement 105 (or head), which is adapted to carry a reel 700 of the covering tape 800.

This reel 700 is rotatably associated with the functional arrangement 105, so as to be adapted to rotate on itself around a predetermined rotation axis A which generally coincides with the winding axis of the covering tape 800, that is with the axis of the tubular support 705.

In particular, the functional arrangement 105 may comprise a support shaft 125 having an axis coincident with the rotation axis A, which is adapted to be coaxially fitted into the centre of the reel 700, for example into the tubular support 705.

This support shaft 125 may be rotatably coupled to the functional arrangement 105 in order to be adapted to rotate on itself around the rotation axis A.

The support shaft 125 is preferably an expandable shaft, for example of a mechanical and/or pneumatic type, which is adapted to vary its outer diameter from a minimum value to a maximum value.

The minimum diameter of the support shaft 125 is less than or equal to the inner diameter of the tubular support 705 of the reel 700, whereas the maximum diameter is potentially greater than said inner diameter.

In this way, when the support shaft 125 is in the minimum diameter configuration, the same can be fitted into the tubular support 705 of the reel 700, after which it can be driven towards the maximum diameter configuration, so as to firmly block said tubular support 705 resulting integral with the reel 700.

It is desired herein to point out that the support shaft 125 may not be a perfectly cylindrical body, or at least may not be a perfectly cylindrical body when it is in maximum diameter configuration.

For example, the support shaft 125 may have a cylindrical body and longitudinal ribs or fins arranged radially about the axis of the cylindrical body, which are movable in a radial direction by effect of the activation of suitable actuation members.

In this way, when the support shaft 125 is in a minimum diameter configuration, said longitudinal ribs may be contained within the cylindrical body or flush therewith while, when the support shaft 125 is in a maximum diameter configuration, said ribs may project with respect to the cylindrical body, causing it to assume a shape assimilable to that of a splined shaft, for example.

However, in each of the above-mentioned configurations, the diameter of the support shaft 125 is generally to be considered as the diameter of the smallest ideal cylinder suitable for circumscribing the support shaft 125 in that configuration.

Regardless of these considerations, the support shaft 125 is preferably installed cantilevered on the functional arrangement 105.

Figure 6:
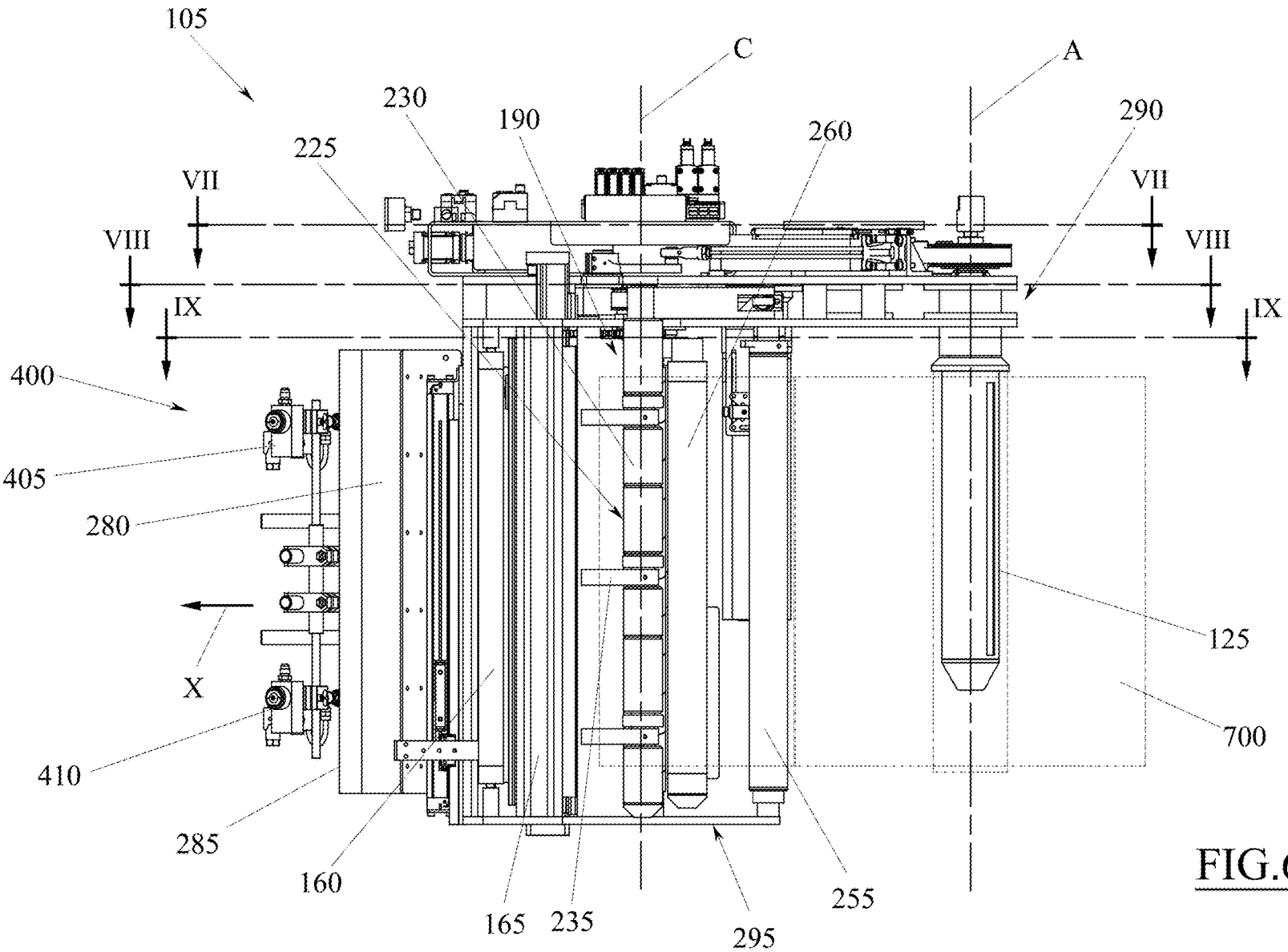
FIG. 6 is a side view of the functional arrangement in FIG. 5.

In other words, as can be clearly seen for example in FIG. 6, the support shaft 125 comprises two axial ends, only one of which is physically and mechanically connected to the functional arrangement 105, for example to a structural frame thereof, while the opposite axial end is completely free.

A motor 130 may be associated with the support shaft 125, for example an electric or hydraulic motor, which is installed on the functional arrangement 105 and is adapted to put in rotation the support shaft 125 and, hence, the reel 700 connected thereto, around the rotation axis A.

This motor 130 may be connected to the support shaft 125 by means of a transmission system, which may comprise a first pulley 135 keyed to the axially constrained end of the support shaft 125, a second pulley 140 keyed to the shaft of the motor 130, and a flexible transmission member 145, such as a belt, wound on the first and second pulley 135 and 140.

The functional arrangement 105 may further comprise a guiding system adapted to engage the covering tape 800 unwinding from the reel 700 in a predetermined path, along which the generatrices of the covering tape 800 remain parallel to the rotation axis A of the support shaft 125, until they reach an exit zone.

At this exit zone, the guiding system is adapted to engage the covering tape 800 to slide along a predetermined advancement direction X substantially rectilinear and orthogonal to the rotation axis A of the support shaft 125.

In order to impose this advancement direction X on the covering tape 800, the guiding system may comprise a pair of support rollers 160, having axes parallel to each other and parallel to the rotation axis A of the support shaft 125, which are separated by a narrow gap within which the covering tape 800 can slide freely but with reduced clearance.

Each support roller 160 may be rotatably coupled to the functional arrangement 105, for example to a structural frame thereof, so as to be adapted to rotate on itself (generally in an idle mode) about its central axis.

The functional arrangement 105 may further comprise a cutting device 165, which is adapted to cut the covering tape 800 unwinding from the reel 700, so as to separate a segment thereof.

This cutting device 165 may be arranged at the exit zone, for example upstream of the support rollers 160, with respect to the advancement direction X of the covering tape 800.

Figure 9:
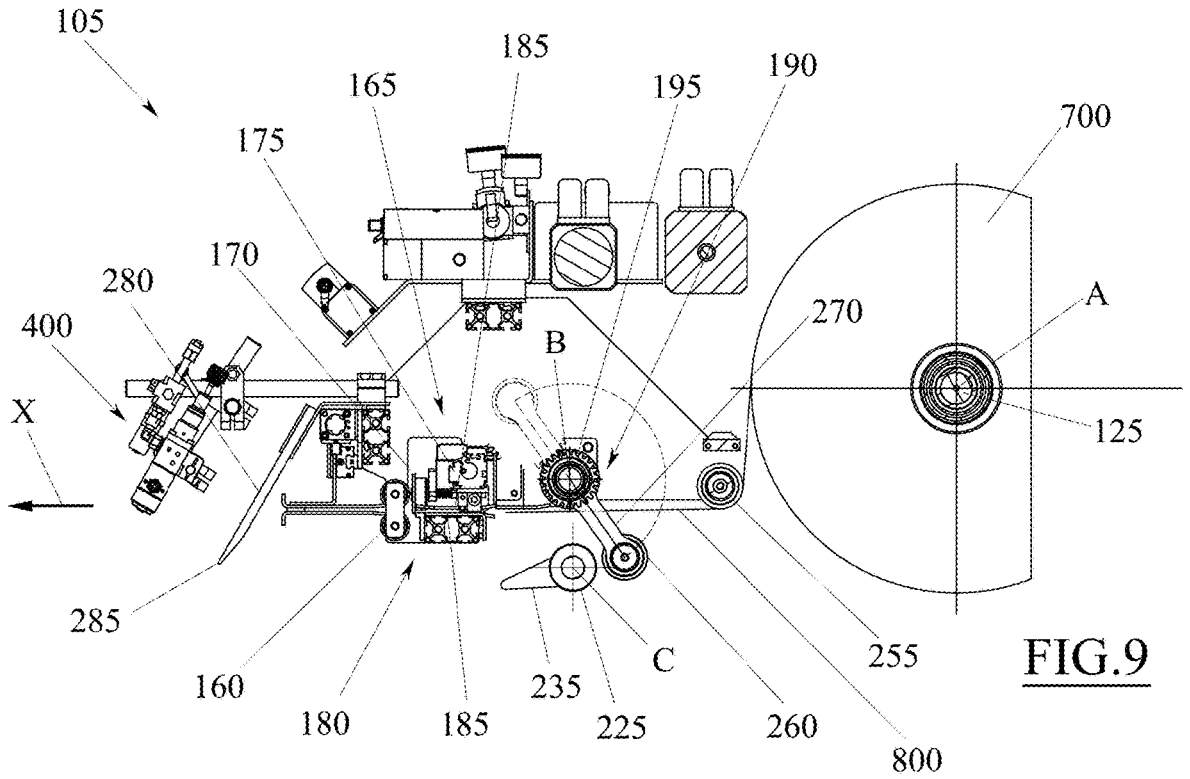
FIGS. 9 and 10 are the section IX-IX plotted in FIG. 6 shown in different operating configurations.
Figure 10:
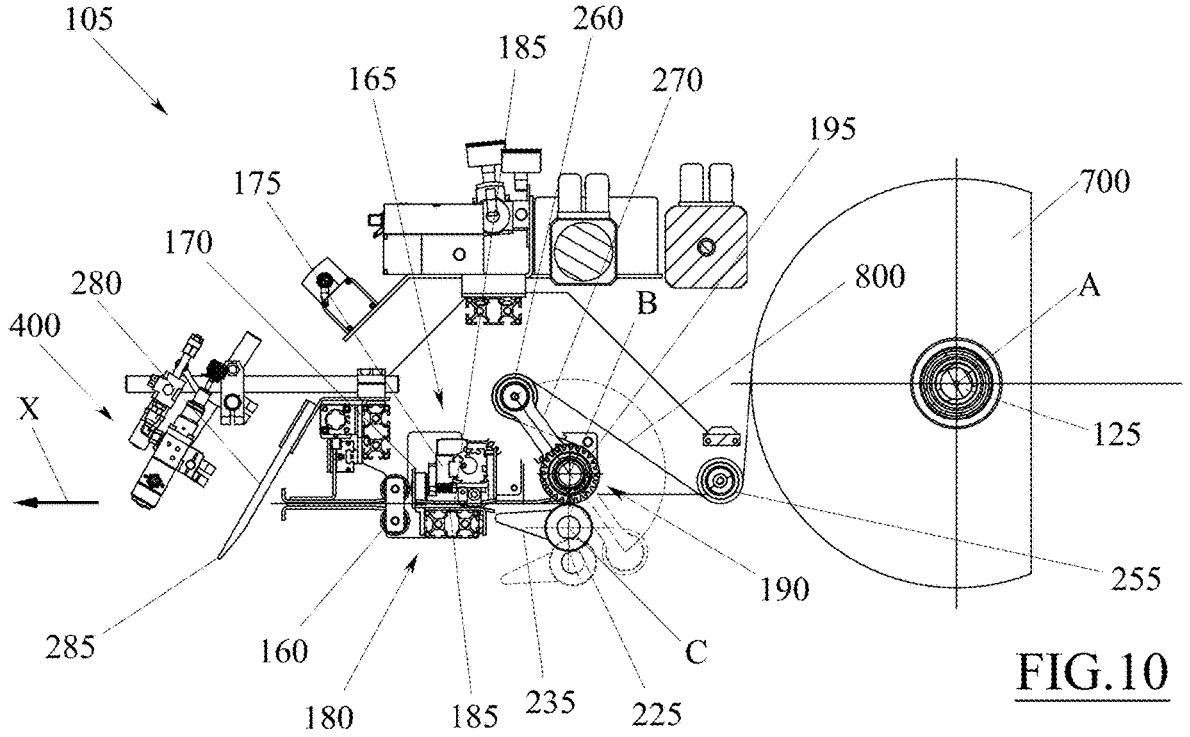

As visible in the detail of FIGS. 9 and 10, the cutting device 165 can comprise a blade 170, for example a rotating blade, and actuator members 175 adapted to move said blade 170 with respect to the covering tape 800 unwinding from the reel 700.

In particular, the blade 170 can be driven for moving in a sliding direction parallel to the covering tape 800 but transversal, typically orthogonal, with respect to the advancement direction X with which said covering tape 800 unwinds from the reel 700.

For example, the sliding direction of the blade 170 can be parallel to the rotation axis A of the support shaft 125.

In this way, the sliding of the blade 170 allows the covering tape 800 to be cut through along its entire width, subdividing it into two separate segments.

The actuator members 175 of the blade 170 can comprise a cylinder/piston arrangement of the pneumatic type or any other device adapted to impose a linear type movement on the blade 170.

To enable an effective cutting of the covering tape 800, the functional arrangement 105 may further comprise a blocking device 180 operatively arranged between the support shaft 125, on which the reel 700 is mounted, and the cutting device 165.

Operatively arranged means that the blocking device 180 is adapted to act on a stretch of the covering tape 800 which is comprised between the support shaft 125 (i.e. the reel 700) and the cutting device 165.

In particular, the blocking device 180 is preferably placed in proximity to, for example substantially close to the blade 170 and is adapted to stably block the covering tape 800 to allow/facilitate the cutting action by the blade 170.

This blocking device 180 may comprise a pair of mutually opposed, flat plates 185, which are arranged parallel to each other and parallel to the rotation axis A of the support roller 125 and between which the covering tape 800 passes.

These plates 185 can be associated with actuator members (not visible) adapted to engage them in a relative movement, for example in a direction orthogonal to the covering tape 800 that crosses them, between a distanced configuration and a neared configuration.

This relative movement can be obtained for example by keeping one of the two plates 185 stationary and by moving the other towards/away from the first one.

When the plates 185 are in a distanced configuration (as illustrated in FIGS. 9 and 10), the covering tape 800 passes through them with a certain clearance, thus resulting free to slide.

On the other hand, when the plates 185 are in a neared configuration (not illustrated), the covering tape 800 is stably blocked and tightened between the plates 185, which prevent it from advancing.

The actuator members of the plates 185 can comprise a cylinder/piston arrangement of the pneumatic type or any other device suitable for the purpose, for example of the electromechanical type.

As anticipated above, between the plates 185 in a distanced configuration a gap remains defined in which the covering tape 800 can pass freely but with preferably reduced clearance.

In this configuration, the plates 185 thus also act as a guide for the covering tape 800 in the advancement direction X.

In fact, the plates 185 are preferably oriented so as to be parallel to the advancement direction X, and the gap between them defined may be aligned, along the same advancement direction X, with the gap defined between the support rollers 160.

In other embodiments, the support rollers 160 may be absent and the guiding system 800 of the covering tape, at the exit zone, may be defined by only the plates 185 associated with the blocking device 180.

To make the covering tape 800 advance after a cutting operation, the functional arrangement 105 may further comprise an actuation device 190 operatively positioned between the blocking device 180 and the support shaft 125 on which the reel 700 is mounted.

Operatively positioned means that the actuation device 190 acts on a stretch of the covering tape 800 comprised between the support shaft 125 (i.e. the reel 700) and the blocking device 180, preferably resulting in proximity thereto.

Another function of the actuation device 190 may be that of braking the sliding of the covering tape 800 during the winding of the palletised load 900.

This actuation device 190 can comprise a drive roller 195 adapted to receive the covering tape 800 in contact, and a motor 200 (visible in FIG. 4) adapted to put the drive roller 195 in rotation around its central axis B.

Figure 8:
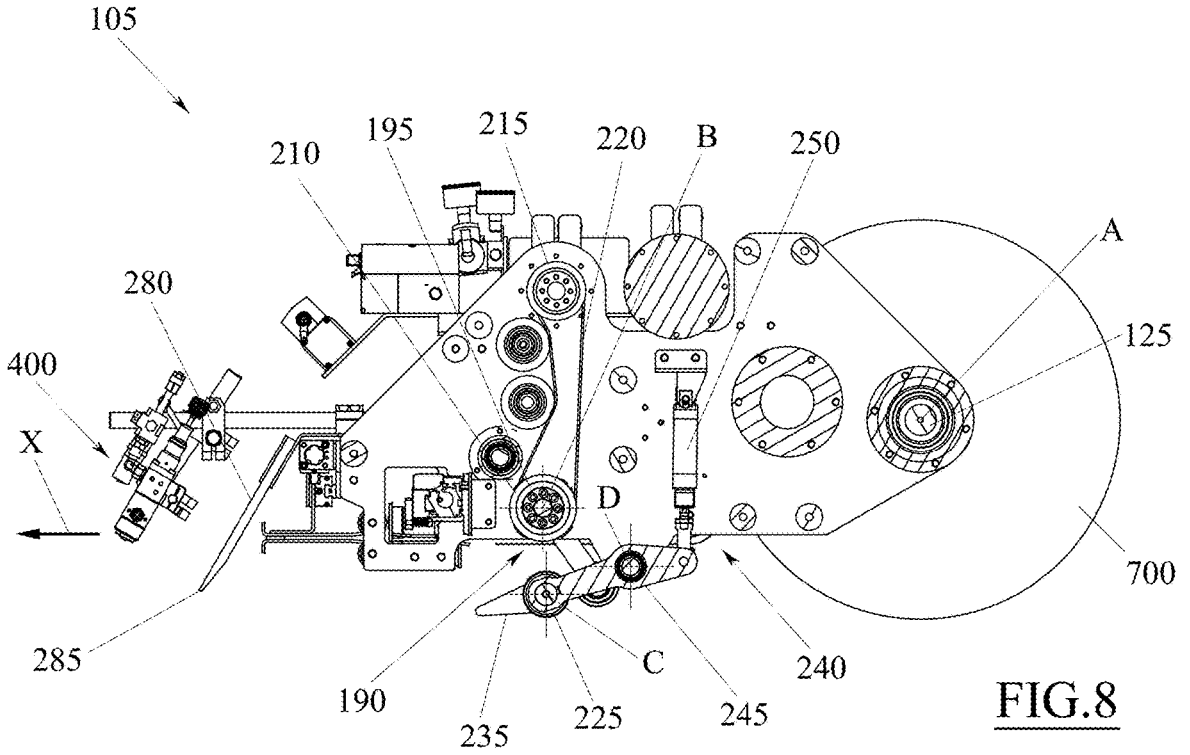
FIG. 8 is the section VIII-VIII plotted in FIG. 6.

This motor 200 may be connected to the drive roller 195 by means of a transmission system (see FIG. 8), which may comprise a first pulley 210 keyed to an axial end of the drive roller 195, a second pulley 215 keyed to the shaft of the motor 200, and a flexible transmission member 220, for example a belt, wound on the first and second pulley 210 and 215.

The central axis B of the drive roller 195 is preferably parallel to the rotation axis A of the reel 700.

The actuation device 190 can further comprise a contrast roller 225, which is adapted to rotate on itself (typically in an idle mode) around its own central axis C, and is adapted to press the covering tape 800 against the drive roller 195.

The central axis C of the contrast roller 225 is preferably parallel to the central axis B of the drive roller 195.

Figure 5:
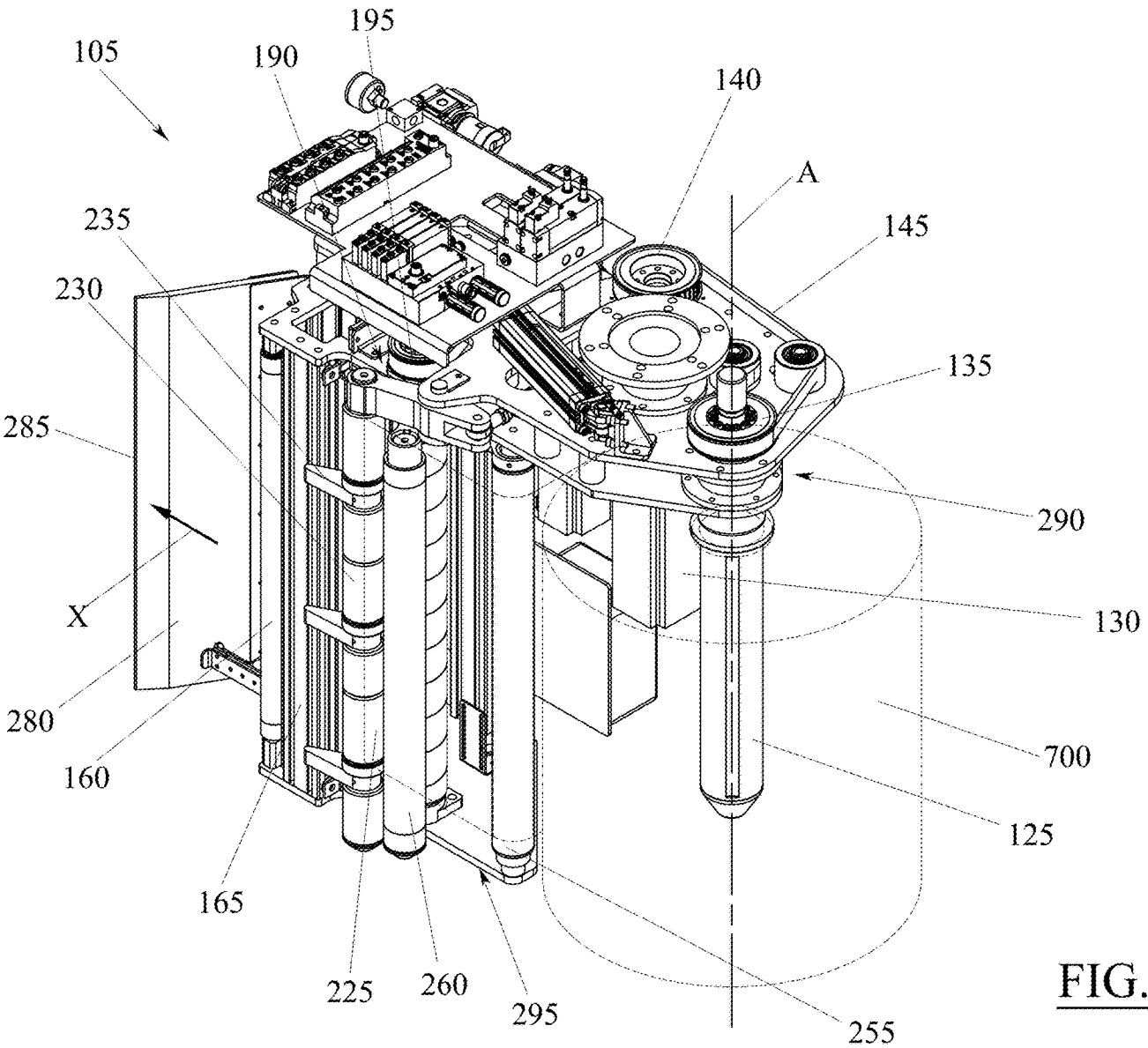
FIG. 5 is an axonometric view of a functional arrangement belonging to the machine of FIG. 4.

As illustrated in FIGS. 5 and 6, this contrast roller 225 can be axially subdivided into a plurality of cylindrical sections 230, mutually coaxial, aligned along the central axis C and preferably having the same diameter, which are adapted to come into contact with the drive roller 195.

These cylindrical sections 230 may be interspersed with one or more guide prongs 235, which are mutually parallel to and radially projecting with respect to the cylindrical sections 230, the function of which is to direct the covering tape 800 unwinding from the reel 700 in the advancement direction, for example towards the cutting device 165.

Regardless of these considerations, the contrast roller 225 is preferably installed cantilevered on the functional arrangement 105.

In other words, as can be clearly seen for example in FIG. 6, the contrast roller 225 comprises two axial ends, only one of which is physically and mechanically connected to the functional arrangement 105, for example to a structural frame thereof, while the opposite axial end is completely free.

In particular, it is preferable that the contrast roller 225 is oriented in the same direction as the support shaft 125.

That is, it is preferable that, from the respective constrained end to the respective free end, the contrast roller 225 and the support shaft 125 extend in the same direction.

In other embodiments, instead of the contrast roller 225, it could be the drive roller 195 that is mounted cantilevered in the same manners as outlined for the contrast roller 225; or, both the contrast roller 225 and the drive roller 195 could be mounted cantilevered in said manner.

In any case, the actuation device 190 can further comprise actuator members 240 (see FIG. 8) adapted to engage the drive roller 195 and the contrast roller 225 in a relative movement, for example in a direction transverse to the respective central axes B and C, between a distanced configuration and a neared configuration.

When the drive roller 195 and the contrast roller 225 are in a distanced configuration (as in FIG. 8), a gap is defined between them, which is also open laterally at the free end of the contrast roller 225 (and/or possibly the drive roller 195), which is preferably aligned with the advancement direction X of the covering tape 800 and through which the covering tape 800 can slide and pass freely.

When, on the other hand, the drive roller 195 and the contrast roller 225 are in a neared configuration (as illustrated in FIG. 10), the covering tape 800 is stably blocked and tightened between these two rollers, so that the sliding thereof in the advancement direction X and/or the braking thereof are generated by the rotation of the drive roller 195.

This relative movement between the distanced position and the neared position can be obtained by keeping the drive roller 195 stationary and by moving only the contrast roller 225 towards/away from the drive roller 195.

For example, the constrained end of the contrast roller 225 may be rotatably coupled to at least one lever 245, shaped for example like a rocker arm, which is rotatably coupled to the functional arrangement 105, for example to a structural frame thereof, so as to be adapted to rotate around a rotation axis D, which is parallel to but distanced from both the central axis C of the contrast roller 225 and the central axis B of the drive roller 195.

By making the lever 245 rotate around the rotation axis D, the actuator members 240 are therefore capable of moving the contrast roller 225 towards/away from the drive roller 195.

The actuator members of the plates 240 can comprise for example a cylinder/piston arrangement 250 of the pneumatic type or any other device suitable for the purpose, for example of the electromechanical type.

Although a solution has been described in which the contrast roller 225 is actively displaced with respect to the drive roller 195, it is not excluded that, in other embodiments, it is the drive roller 195 that is actively displaced with respect to the contrast roller 225.

The functional arrangement 105 may further comprise a first return roller 255, having an axis parallel to the axis of the support shaft 125 and rotatable on itself around its own axis (preferably in idle mode), which is operatively positioned in a preferably fixed position between the actuation device 190 and the support shaft 125 on which the reel 700 is mounted.

Operatively positioned means that the first return roller 255 is adapted to interact with a stretch of the covering tape 800 comprised between the actuation device 190 and the support shaft 125 (i.e., the reel 700).

This first return roller 255 is positioned and sized so as to result substantially tangent to at least one imaginary plane which is parallel to the rotation axis A of the support shaft 125 and which passes through the gap comprised by the drive roller 195 and the contrast roller 225, when the latter are in a distanced configuration, resulting, for example, parallel to the advancement direction X of the covering tape 800 in the exit zone.

In this way, the first return roller 255 is adapted to deflect the path of the covering tape 800 unwinding from the reel 700, directing it in the advancement direction X. The functional arrangement 105 may also comprise a second return roller 260, also having an axis parallel to the axis of the support shaft 125 and rotatable on itself around its own axis (preferably in idle mode), which is operatively positioned between the actuation device 190 and the first return roller 255.

Operatively positioned means that the second return roller 260 is adapted to interact with a stretch of the covering tape 800 comprised between the actuation device 190 and the first return roller 255.

The second return roller 260 is also preferably cantilevered installed on the functional arrangement 105.

In other words, as clearly visible for example in FIG. 6, the second return roller 260 also comprises two axial ends, only one of which is physically and mechanically connected to the functional arrangement 105, for example to a structural frame thereof, while the opposite axial end is completely free.

In particular, it is preferable that the second return roller 260 is oriented in the same direction as the support shaft 125.

That is, it is preferable that, from the respective constrained end to the respective free end, the second return roller 260 and the support shaft 125 extend in the same direction.

Figure 7:
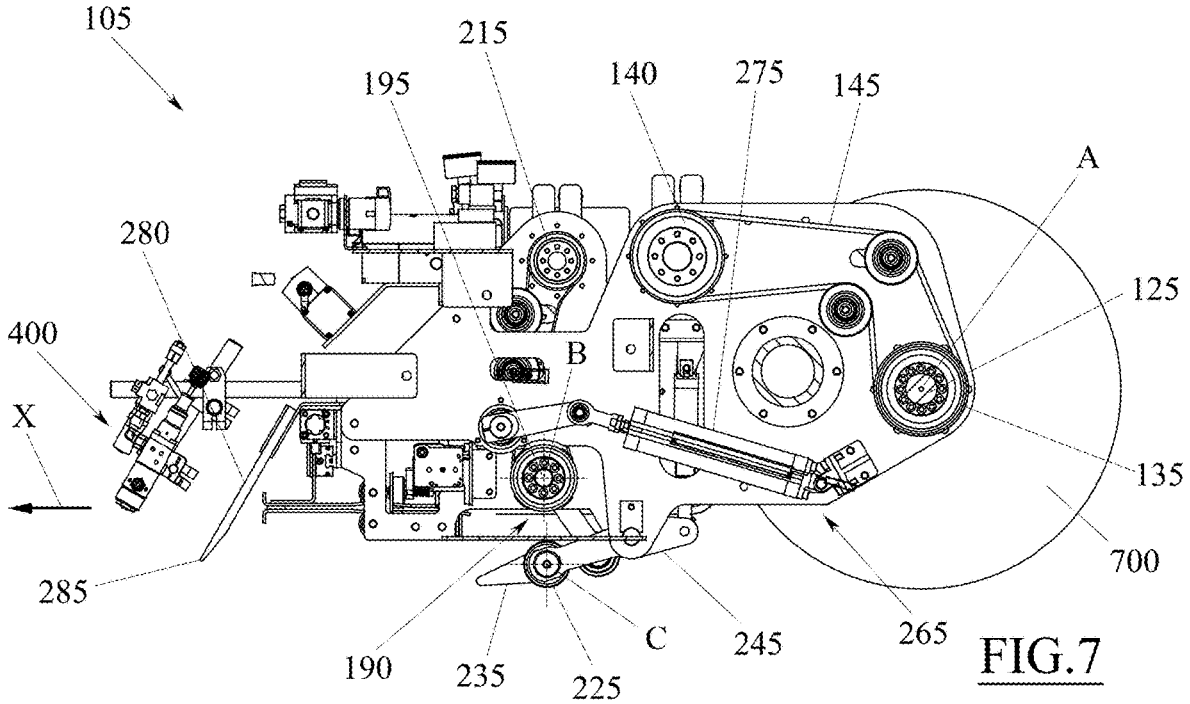
FIG. 7 is the section VII-VII plotted in FIG. 6.

The functional arrangement 105 may therefore comprise actuator members 265 (see FIG. 7) adapted to displace the second return roller 260 transversely with respect to its axis between a disengagement position and an engagement position. In the disengagement position (see FIG. 9), the axis of the second return roller 260 is located in one of the two half-spaces that are defined by the imaginary plane contains the rotation axis B of the drive roller 195 and the rotation axis of the first return roller 255, preferably in the half-space in which the rotation axis C of the contrast roller 225 is contained.

In the engagement position (see FIG. 10), the axis of the second return roller 260 is instead located in the opposite half-space, after having passed between the first return roller 255 and the drive roller 195.

This movement of the second return roller 260 may be achieved by rotating the second return roller 260 around a revolution axis parallel to but distanced from the axis of the return roller 260, for example around a revolution axis coincident with the rotation axis B of the drive roller 195.

For example, the constrained end of the second return roller 260 may be rotatably coupled to at least one lever 270, which is rotatably coupled to the functional arrangement 105, for example to a structural frame thereof, according to the aforementioned revolution axis, and the actuator members 265 may be adapted to rotate said lever 270 around said revolution axis.

These actuators 265 may comprise, for example, an electric, pneumatic or any other type of jack 275 (see FIG. 7), which is adapted to put the lever 270 in rotation by means of a gear or any other transmission system.

Alternatively, the actuator members 265 could comprise an electric or pneumatic motor or any other device suitable for the purpose, for example of an electromechanical type.

In any case, to pass from the disengagement position to the engagement position, the actuator members 265 may engage the second return roller 260 to make a rotation of about 180° sexagesimal about the revolution axis.

In this way, as it passes around the first return roller 255, the second return roller 260 and the drive roller 195, the covering tape 800 is engaged in a tortuous movement that defines a kind of reserve or stock of tape, the extension of which varies according to the position of the second return roller 260, the displacement of which can be managed so as to keep the covering tape 800 at an optimal tension throughout the winding of the palletised load 900.

During operation of the machine 100, the actuator members 265 may in fact be configured to allow an adjustment of the angular position of the second return roller 260 within an angle of about 20° starting from the engagement position towards the disengagement position, preferably remaining in the same half-space and thus without passing again through the drive roller 195 and the first return roller 255.

The functional arrangement 105 may further comprise a spatula 280, which may be installed downstream of the cutting device 165, with respect to the advancement direction X of the covering tape 800, and preferably also downstream of the support rollers 160 (if any).

In other words, the spatula 280 may be positioned such that the cutting device 165 is placed between the actuation device 190 and the spatula 280.

The spatula 280 can be shaped as a flat sheet, for example rectangular in shape, having at least one extremal edge 285 that extends parallel to the rotation axis A of the support shaft 125.

This spatula 280 can be positioned so as to ideally intersect the advancement direction X with which the covering tape 800 exits the functional arrangement 105.

The spatula 280 can also be inclined with respect to said advancement direction X, for example by an angle comprised between 0° and 90° (extremes excluded), preferably by an angle comprised between 20° and 70° (extremes included).

The spatula 280 can be made of a flexible material, such as rubber.

It should be noted herein that, in the illustrated embodiment, the functional arrangement 105 may comprise substantially a single rigid structural frame, on which there is mounted both the support shaft 125 and the actuation device 190, as well as possibly each of the other devices and apparatuses described above, including, for example, the cutting device 165, the blocking device 180, the first and second return roller 255 and 260, and finally also the spatula 280.

In particular, this structural frame may comprise at least a first planar structure 290 (see FIGS. 5 and 6), oriented substantially squared with respect to the rotation axis A of the support shaft 125, to which the support shaft 125, the contrast roller 225 and possibly the second return roller 260 (if any) are connected cantilevered, so that they all project from the same side as explained above.

For example, the first planar structure 290 may comprise two parallel and opposed plates (joined together by suitable connecting bodies), between and above which one or more of the motors and/or actuation members already described may be installed.

The structural frame may further comprise a second planar structure 295, defined, for example, by a single plate oriented parallel to the preceding plates, which may serve as a further support element for the not cantilevered components of the functional arrangement 105, such as, for example, the drive roller 195, the first return roller 255, the cutting device 165, the support rollers 160, and the spatula 280.

Said second planar structure 295 is, however, conformed in such a way that it does not face the free ends of the cantilevered components, such as, for example, the support shaft 125, the contrast roller 225 and the second return roller 260 (the latter at least when it is in the disengagement position), so that the same are accessible from the outside along a direction parallel to the rotation axis A of the support shaft 125.

In any case, thanks to the presence of the rigid structural frame, all the devices of the functional arrangement 105 described above are constrained to move integrally with each other following any movement imparted to the structural frame itself.

In other words, the structural frame makes sure that the functional arrangement 105 can be manipulated as a single rigid body.

Figure 4:
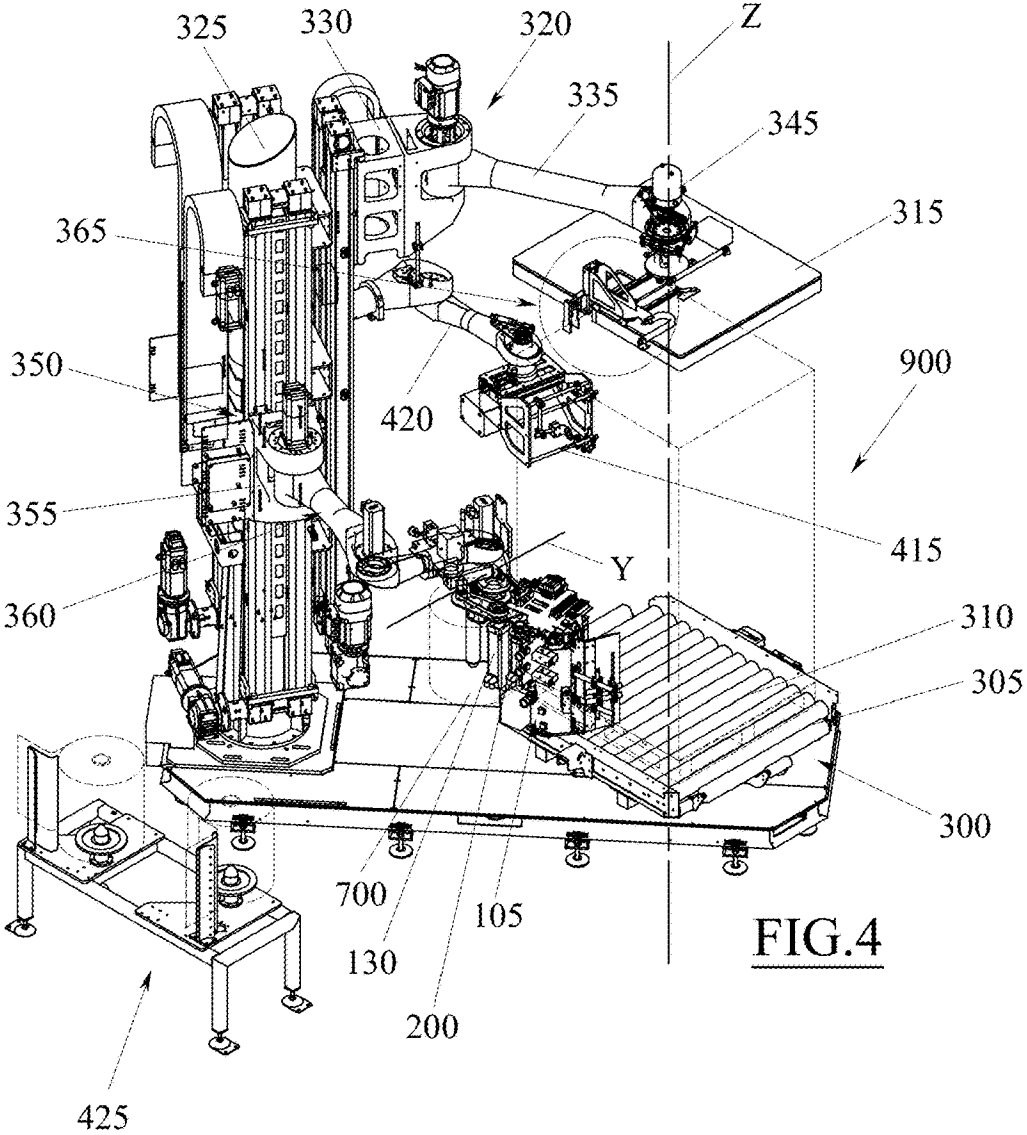
FIG. 4 is an axonometric view of a machine for stabilising palletised loads according to an embodiment of the present invention.

In this regard, the machine 100 can comprise a first movement apparatus 300 adapted to produce a relative motion of revolution of the functional arrangement 105 around the palletised load 900, with respect to a predetermined, preferably vertical, revolution axis Z (see FIG. 4).

Relative motion of revolution means that the functional arrangement 105 rotates around the palletised load 900 with respect to a reference system integral with the palletised load 900, regardless of whether the actual movement is imparted to the functional arrangement 105 or to the palletised load 900.

Thus, for example, in the illustrated embodiment, the first movement apparatus 300 is actually adapted to put the palletised load 900 in rotation on itself.

For this purpose, the first movement apparatus 300 can comprise a platform 305, which makes a rest surface 310, preferably horizontal, available for the palletised load 900.

In particular, the rest surface 310 can be defined by a roller conveyor which, when installed on the platform 305, facilitates the positioning and subsequent distancing of the palletised load 900.

The first movement apparatus 300 further comprises actuator members (not illustrated) adapted to put the platform 305 in rotation around a rotation axis orthogonal to the rest surface 310 and coincident with the axis, for example substantially vertical, of revolution Z.

In particular, the rotation axis of the platform 305 can pass internally to the rest surface 310, so that the palletised load 900 can substantially pivot on itself.

In a position superimposed on the rest surface 310, the machine 100 can comprise an upper pad 315, which is adapted to stay in contact with the top of the palletised load 900.

This upper pad 315 can be substantially shaped as a flat plate, for example substantially rectangular/square in shape, and oriented horizontally.

The upper pad 315 can be associated with a lifting apparatus 320 adapted to move it in the vertical direction, so as to bring it closer to and away from the rest surface 310, for example to free the palletised load 900 or to adjust the position thereof according to the height of the latter.

This lifting apparatus 320 can comprise for example a supporting column 325 and a carriage 330 slidingly associated with the supporting column 325, so as to be able to slide on it in a vertical direction, driven by suitable motors.

In particular, vertically oriented linear sliding guides on which coupling runners fixed to the carriage 330 slide can be fixed to the supporting column 325.

The lifting apparatus 320 can further comprise a cantilevered, preferably horizontal, arm 335 which connects the carriage 330 to the upper pad 315.

To allow a correct positioning of the upper pad 315, one end of the cantilevered arm 335 can be articulated to the carriage 330 according to a vertical articulation axis, so that the cantilevered arm 335 can rotate like a flag.

This rotation of the cantilevered arm 335 can be driven by an electric motor.

The upper pad 315 can also be adapted to rotate on itself around a vertical rotation axis, which is coincident (or can be brought so as to be coincident) with the revolution axis Z.

For example, the upper pad 315 can be hinged, according to said rotation axis, to a second end of the cantilevered arm 335, and can be drive for rotation by a motor 345 or by any other actuator member.

In particular, it is preferable that the rotation of the upper pad 315 occurs substantially simultaneously and substantially at the same speed as the rotation of the platform 305, so that the palletised load 900 is not subjected to significant torsional stresses.

Although in the previous description reference has been made to a first movement apparatus 300 adapted to rotate the palletised load 900, it is not excluded that, in other embodiments, the palletised load 900 may remain stationary, for example resting on a rest surface 310 made available by a floor or any other fixed base, and that the first movement apparatus 300 is configured to actively move the functional arrangement 105 with a revolution movement around the palletised load 900.

Also in this case, the machine 100 could in any case comprise an upper pad 315 adapted to remain in contact and integral with the top of the palletised load 900 (in this case also stationary).

Regardless of these considerations, the machine 100 further comprises a second movement apparatus 350, which is adapted to produce at least a relative motion of translation of the functional arrangement 105 with respect to the palletised load 900, along a direction parallel to the revolution axis Z, or preferably in the vertical direction.

Relative motion of translation means that the functional arrangement 105 and the palletised load 900 are mutually movable in a direction parallel to the revolution axis Z, regardless of whether the actual movement is of one or the other.

Thus, for example, in the illustrated embodiment, the second movement apparatus 350 is adapted to actively move the functional arrangement 105 in the vertical direction, while the palletised load 900 remains stable on the rest surface 310. However, it is not excluded that, in other embodiments, the second movement apparatus 350 may be configured to move the palletised load 900 vertically, for example by lifting and/or lowering the corresponding platform 305.

In any case, the second movement apparatus 350 is preferably configured to also allow a displacement of the functional arrangement in a plane orthogonal to the revolution axis Z, that is in a preferably horizontal plane, as well as to allow a variation in the orientation of the functional arrangement 105, and consequently of the rotation axis A of the reel 700, through rotation around a further oscillation axis Y perpendicular to the revolution axis Z, that is preferably horizontal.

To obtain these degrees of freedom, the second movement apparatus 350 can first of all comprise a supporting column and a carriage 355 slidingly associated with said supporting column, so as to be able to slide vertically thereon, driven by suitable motors.

In the illustrated example, the supporting column of the second movement apparatus 350 can coincide with the supporting column 325 of the lifting apparatus 320 of the upper pad 315.

In particular, the supporting column 325 can be provided with linear sliding guides, oriented vertically, and on which corresponding coupling runners fixed to the carriage 355 slide.

The second movement apparatus 350 can further comprise a cantilevered arm 360, preferably horizontal, which connects the carriage 355 to the functional arrangement 105, that is to the structural frame.

The cantilevered arm 360 can be an articulated arm with parallel, for example all vertical, axes to allow a more efficient positioning of the functional arrangement 105.

In particular, the cantilevered arm 360 can comprise two stretches in series, of which a first stretch articulated to the carriage 355 and a second stretch articulated to the free end of the first stretch.

The rotation of the first stretch with respect to the carriage 355 can be driven by an electric motor, while the rotation of the second stretch with respect to the first stretch can be driven by another electric motor.

In practice, the carriage 355 and the cantilevered arm 360 define a so-called SCARA robot.

The structural frame of the functional arrangement 105 may be connected to the cantilevered arm 360, i.e. to the free end of the second stretch, by interposition of a first articulated joint allowing it to rotate around an articulation axis parallel to that defined between the cantilevered arm 360 and the carriage 355, i.e. preferably vertical.

The rotation of the structural frame of the functional arrangement 105 with respect to this articulation axis may be driven by a dedicated electric motor.

In addition or alternatively, the structural frame of the functional arrangement 105 may be connected to the cantilevered arm 360 by means of a further articulated joint defining the aforementioned oscillation axis Y.

The rotation of the functional arrangement 105 with respect to this oscillation axis Y can be driven by a further dedicated electric motor.

The machine 100 further comprises a gripping device 365, which is adapted to seize a first free end of the covering tape 800 unwinding from the reel 700 mounted on the functional arrangement 105, to make it integral with the palletised load 900.

This gripping device 365 can be positioned at the top of the palletised load 900 and is adapted to remain integral with the latter during the relative revolution and translation movements of the functional arrangement 105.

For example, the gripping device 365 may be installed on board the upper pad 315.

However, it is not excluded that, in other embodiments, the gripping device 365 may be positioned at the base of the palletised load 900, for example on board the platform 305.

Figure 4A:
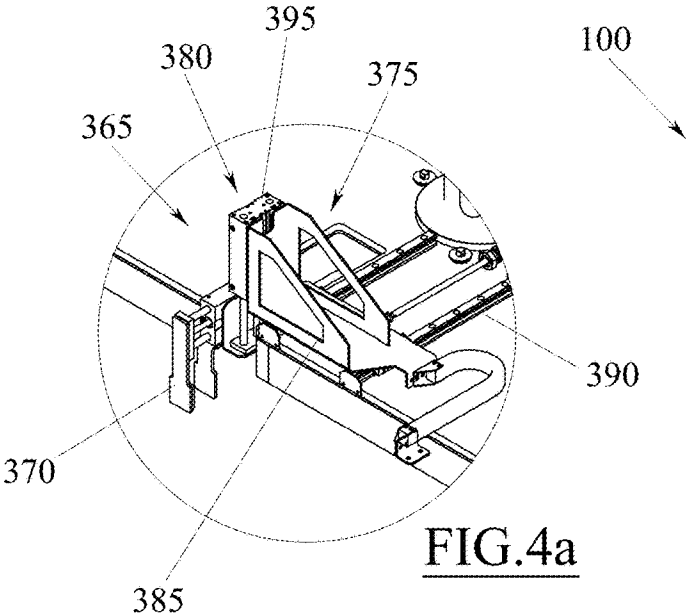
FIG. 4*a* is an enlarged detail of FIG. 4.

As illustrated in FIG. 4*a*, this gripping device 365 can comprise a gripper member 370 provided with at least two jaws that are reciprocally movable towards and away from each other, so as to be able to selectively tighten or release an edge of the covering tape 800 which is positioned between them.

This movement of the jaws of the gripper member 370 can be driven by means of a cylinder-piston arrangement of the pneumatic type or by any other actuation system, for example electromechanical.

The jaws of the gripper member 370 can protrude from the upper pad 315 towards the rest surface 310, so as to be at least partially flanked to the side wall of the palletised load 900.

The gripping device 365 can further comprise actuator members 375 adapted to move the gripper member 370 along a predetermined sliding direction, towards and away from the revolution axis Z, and therefore with respect to the side wall of the palletised load 900.

The sliding direction of the gripper member 370 can be orthogonal to the revolution axis Z, for example horizontal.

Other actuator members 380 can further be provided to move the gripper member 370 also in a direction parallel to the revolution axis Z.

In particular, the gripper member 370 can be positioned at a slot obtained in the upper pad 315, installed on board a carriage 385 which is slidingly coupled to linear guides 390, oriented parallel to the sliding direction, which can be fixed above the upper pad 315.

The actuator members 375 can comprise a cylinder-piston arrangement of the pneumatic type or any other type of actuator, for example electromechanical, adapted to make the carriage 385 slide on the linear guides 390.

Another pneumatic cylinder-piston arrangement 395 or any other type of actuator, for example electromechanical, adapted to have the gripper member 370 slide in a vertical direction can be installed on the carriage 385.

In addition to what has been described so far, the machine 100 further comprises a fixing device 400, which is adapted to fix the windings of covering tape 800 around the palletised load 900.

In the illustrated embodiment, this fixing device 400 is installed directly on board the functional arrangement 105, i.e., connected to the structural frame thereof.

In other embodiment, the fixing device 400 could be installed on an independent frame 415, which can in turn be associated with a third movement apparatus 420, for example with a further SCARA robot, which is adapted to move the fixing device 400 at least along a direction parallel to the revolution axis Z, for example vertical, and, more preferably, also in multiple positions in the plane orthogonal to said revolution axis Z, so as to be able to position it appropriately with respect to the palletised load 900.

As illustrated in FIG. 6, the fixing device 400 comprises one or more guns for dispensing an adhesive adapted to be applied on the windings of the covering tape 800.

For example, these dispensing guns can comprise one or more dispensing guns 405 of a hot glue and, optionally, one or more dispensing guns 410 of a cold glue. However, it is not excluded that, in other embodiments, the fixing device 400 may comprise only hot glue dispensing guns 405 or only cold glue dispensing guns 410.

Nor is it excluded that other embodiments may provide for replacing the adhesive dispensing guns with nail guns, staple guns, banding devices or any other device suitable for applying an element, substance or treatment that allows to join and/or to keep the windings of the covering tape 800 joined.

In view of the foregoing, the operation of the machine 100 is described below.

Initially, the palletised load 900 is loaded onto the rest surface 310 and the upper pad 315 is brought into contact with the top thereof, possibly causing it to exert a certain downward pressure.

While the palletised load 900 is stationary in this position, the functional arrangement 105 can be oriented, by means of the second movement apparatus 350, in such a way that the rotation axis A of the reel 700 and thus the orientation of the covering tape 800 are substantially parallel to the revolution axis Z, i.e. substantially vertical.

Again by means of the second movement apparatus 350, the functional arrangement 105 can be brought in proximity to the palletised load 900 and at the gripping device 365, so that a first (free) end of the covering tape 800 associated with the reel 700, i.e. the one protruding downstream of the cutting device 165, can be vertically aligned with the gripper member 370.

At this point, the gripper member 370 can be lowered, so that said first end of the covering tape 800 is fitted between the jaws thereof, which are subsequently tightened together in order to seize it and hold it firmly.

Subsequently, the gripper member 370 can be moved towards the revolution axis Z, dragging therewith the covering tape 800 (which therefore begins to unwind from the reel 700), until it is positioned in the immediate vicinity of the side wall of the palletised load 900.

At the end of this step, the platform 305 and the upper pad 315 can be put in rotation around the revolution axis Z, by actuating the rotation of the palletised load 900 as well.

In this way, the reel 700 which is on board the functional arrangement 105 begins to perform a relative revolution movement around the palletised load 900.

During this revolution movement, since the first end of the covering tape 800 remains integral with the palletised load 900, the covering tape 800 is automatically dragged so as to unwind from the reel 700 and to wind around the palletised load 900.

This unwinding of the covering tape 800 may be assisted and, if necessary, controlled by the simultaneous actuation of the support shaft 125 by the motor 130.

During winding, the actuation device 190 of the functional arrangement 105 may be inactive, for example with the drive roller 195 stopped and the contrast roller 225 in a distanced configuration.

More preferably, however, the drive roller 195 and the contrast roller 225 may be kept in a neared configuration, using the drive roller 195 as a brake, such that the covering tape 800 remains suitably taut.

The first windings of covering tape 800 can be perfectly horizontal and mutually superimposed at the top band of the palletised load 900.

After these first windings, the gripping device 365 can optionally release the first end of the covering tape 800 which remains integral with the palletised load 900 thanks to the windings.

Thereafter, while the palletised load 900 continues to rotate, the second movement apparatus 350 can begin to displace the functional arrangement 105 in a vertical downward direction.

In this way, the covering tape 800 is wound around the palletised load 900 with a spiral course, until it completely covers the side wall.

Since the covering tape 800 can be substantially inextensible, in order to accompany this spiral course, the second movement apparatus 350 orients the functional arrangement 105, by making it rotate around the oscillation axis Y (or allowing it to rotate around the oscillation axis Y), in such a way that the rotation axis A of the reel 700 always remains substantially orthogonal to the direction of the helix.

During each rotation of the palletised load 900, the dispensing guns of the fixing device 400 can dispense (e.g. spray) a certain amount of adhesive onto the winding of the covering tape 800 that has been previously made, so that said adhesive remains interposed between the previous winding and the one being made, joining them together and making the wrapping more stable.

In particular, the adhesive used in this step can be the cold glue dispensed by the dispensing guns 410.

At the base of the palletised load 900, the translational movement of the functional arrangement 105 is stopped and it can be made to rotate around the oscillation axis Y, so as to bring back the rotation axis of the reel 700 vertically.

At this point it is possible to make a few final windings of the covering tape 800, with a horizontal course and perfectly overlapping one another, at the base of the palletised load 900.

Obviously, should the gripping device 365 be placed on the platform 305, the winding of the palletised load would take place in the opposite direction from the bottom to the top.

In any case, upon completion of this step, the platform 305 and the upper pad 315 may be stopped.

The dispensing guns of the fixing device 400 can therefore be commanded for dispensing (e.g. spraying) a certain amount of adhesive onto the portion of the envelope facing the last stretch of the covering tape 800 coming from the reel 700.

The adhesive used in this step can be the hot glue dispensed by the dispensing guns 405, as it is characterized by shorter setting times than the cold glue.

Through the second movement apparatus 350, the functional arrangement 105 can then be approached to the palletised load 900, so as to begin to bring the last stretch of the covering tape 800 coming from the reel 700 into contact with the palletised load 900, above the previously dispensed adhesive.

At the same time, the cutting device 165 comes into operation which separates the segment of covering tape 800 wound around the palletised load 900 from the one that remains connected to the reel 700.

In this way, the segment of covering tape 800 wound around the palletised load 900 will have a second free end, which can be stretched and pressed against the adhesive previously dispensed by means of the extremal edge 285 of the spatula 280 which, by means of the second movement apparatus 350, is brought into contact and suitably made to slide against the previously wrapped palletised load 900.

The segment of covering tape 800 which remains associated with the reel 700 will now have a new free end positioned at the cutting device 165, for example retained by the blocking device 180.

In order to make this free end protrude beyond the cutting device 165, for example beyond the supporting rollers 160, and thus make it available for stabilising another palletised load 900, the actuation device 190 can now be put into operation.

In particular, the contrast roller 225 can be brought into contact with the drive roller 195 and the latter can be driven for rotation, so as to unwind at least a part of the covering tape 800 from the reel 700, thus making it advance until the free end will be sufficiently protruding to be seized again by the gripper member 370 of the gripping device 365.

The operation of the machine 100, as outlined above, can be entirely commanded and controlled by at least one electronic unit (not illustrated), which is suitably programmed and connected with the various devices and apparatuses of the machine 100.

When the covering tape 800 of the reel 700 has run out, the reel should be removed and replaced.

To perform this operation, the drive roller 195 and the contrast roller 225 may be moved to a distanced position, and the second return roller 260 may be moved to a disengagement position.

By means of the second movement apparatus 350, the functional arrangement 105 can be oriented so that the support shaft 125 is vertical and with the free end facing downward.

The support shaft 125 can then be brought into a minimum diameter configuration, allowing the tubular support 705 to slip off spontaneously by gravity.

Then, a new reel 700 (filled with covering tape 800) is to be mounted on the functional arrangement 105.

For this purpose, the machine 100 can be equipped with a magazine 425 in which one or more reels 700 of covering tape 800 adapted to be mounted on the functional arrangement 105 can be prepared.

Figure 11:
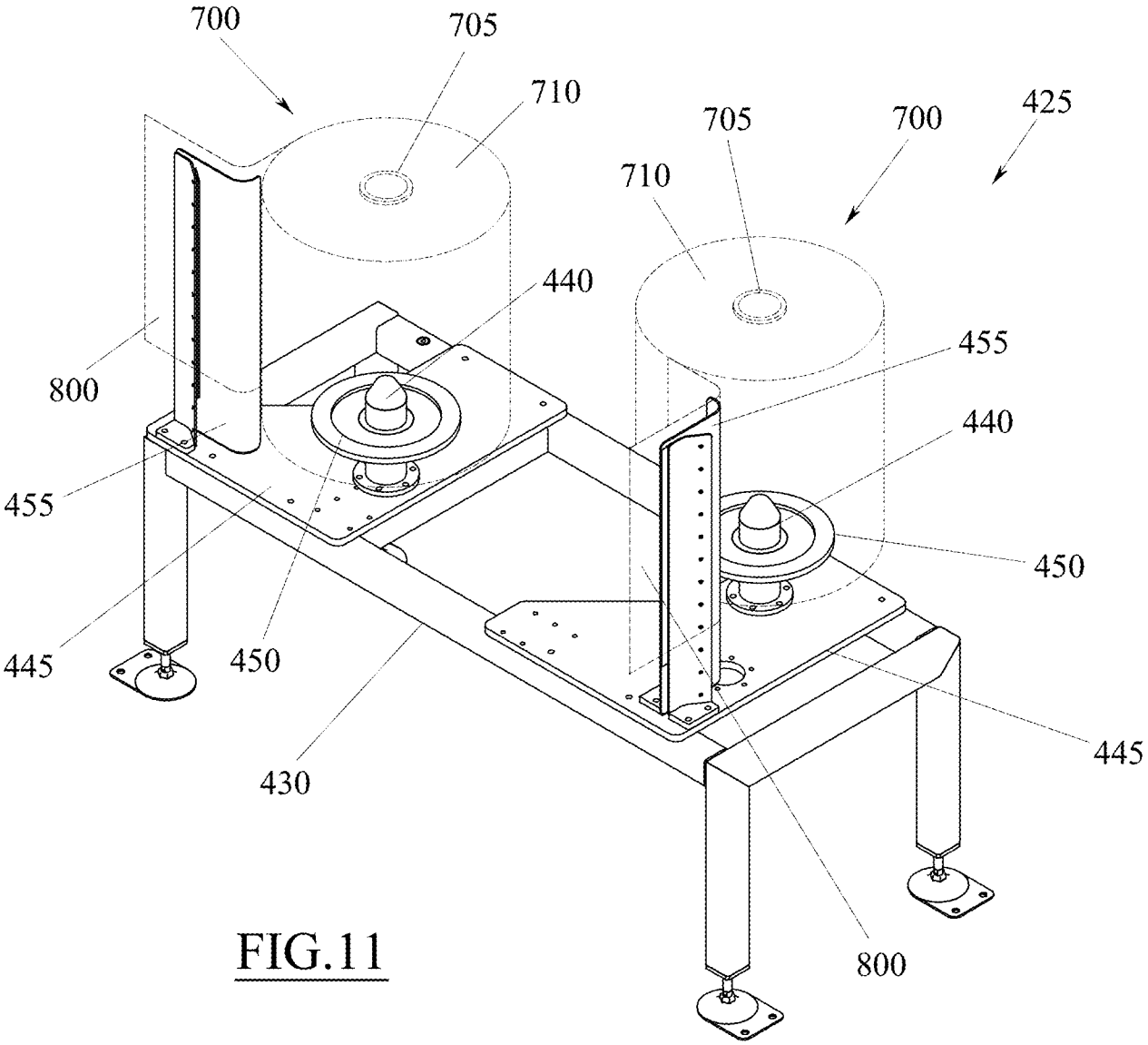
FIG. 11 is an axonometric view of a magazine for reels of covering tape belonging to the machine of FIG. 4.

As illustrated in particular in FIG. 11, this magazine 425 may comprise a support structure 430, conformed for example as a sort of table, on which each reel 700 may be prepared so as to present its axis oriented according to a predetermined inclination, preferably vertical.

To this end, the magazine 425 may comprise one or more pins 440, for example with a vertical axis, on each of which the tubular support 705 of a respective reel 700 may be coaxially fitted.

Each of these pins 440 may stand projecting from a base shelf 445, for example horizontal, which may be brought and fixed to the top of the support structure 430.

A radially projecting flange 450, for example of a discoidal shape, may also be associated with each of these pins 440 and which is fixed to an intermediate stretch of the respective pin 440 so that the respective reel 700 can be supported in a position above the base shelf 445.

The magazine 425 may further comprise one or more supports 455, each of which is operatively associated with a respective pin 440 and is adapted to support an initial portion of the covering tape 800, already partially unwound from the corresponding reel 700, in such a way that said initial portion is substantially planar and parallel to the axis of the reel 700, while leaving the free end thereof accessible.

Each of these supports 455 may be conformed as a sort of clip or fork that may stand projecting from the base shelf 445, alongside and distanced from the corresponding pin 440.

Figure 12D:
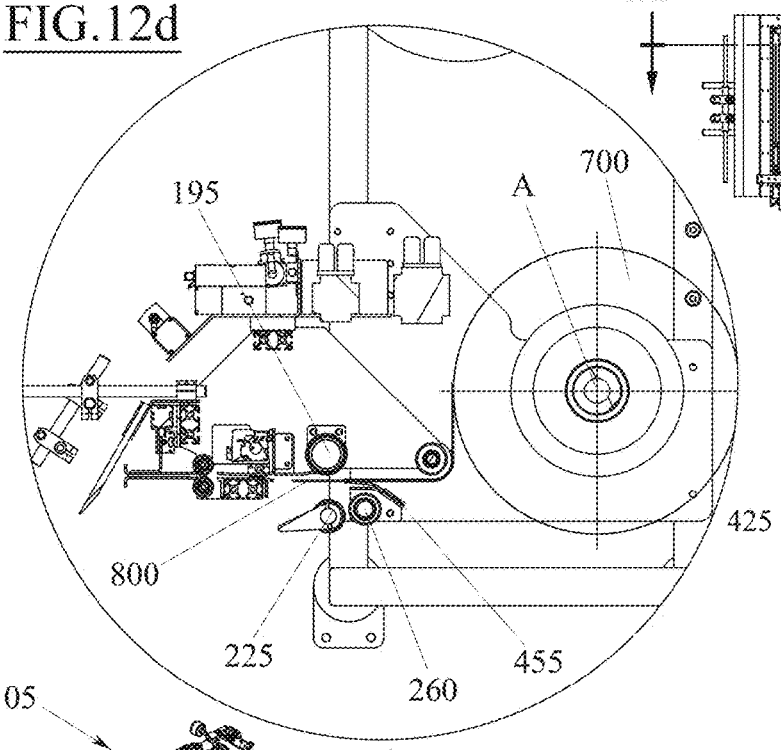
FIG. 12*d* is an enlarged detail of FIG. 12*c*.
Figure 12B:
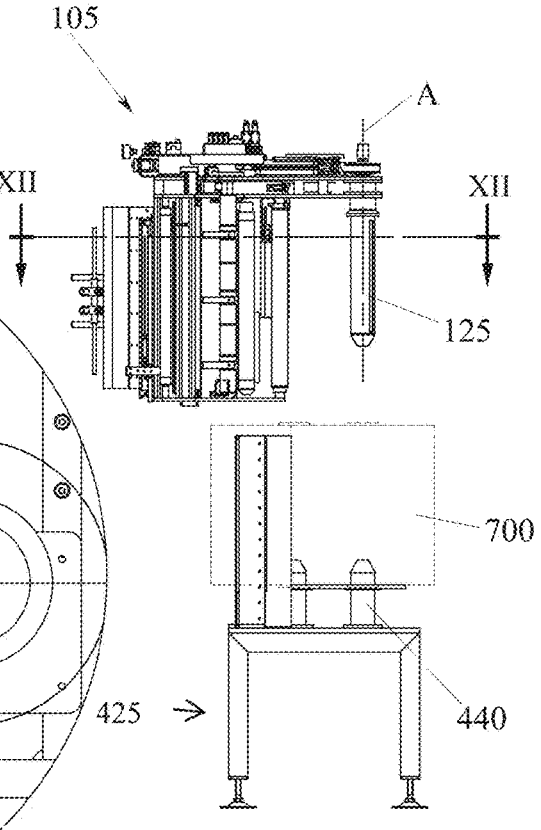
FIG. 12*b* is a side view of what is depicted in FIG. 12*a*.
Figure 12A:
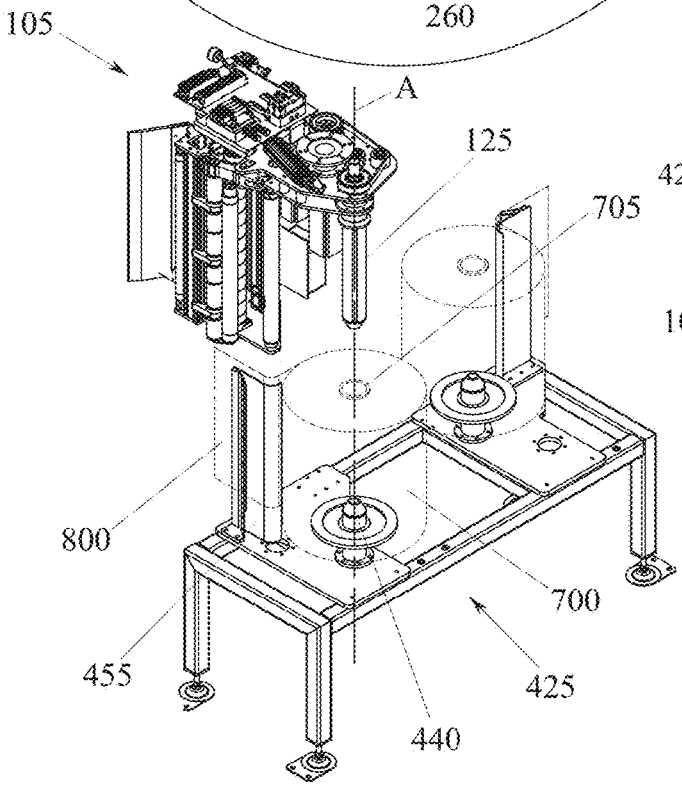
FIG. 12*a* is an axonometric view of a first step of the operation of picking up a reel from the magazine of FIG. 11 by the functional arrangement of FIG. 5.
Figure 12C:
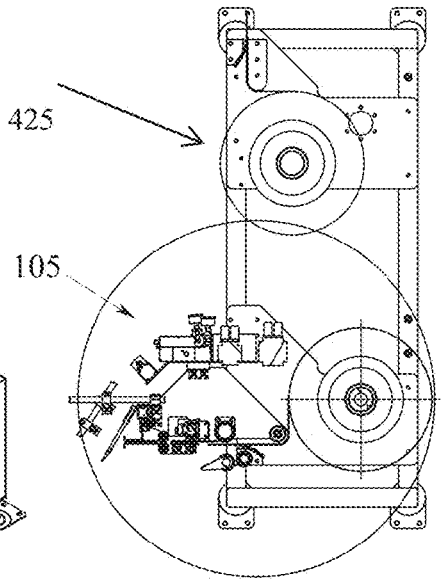
FIG. 12*c* is a plan view of what is depicted in FIG. 12*a*.

In order to load a reel 700 onto the functional arrangement 105, the second movement apparatus 350 may be configured to move and orient the functional arrangement 105 so that the support shaft 125 is coaxial with one of the pins 440, with the free end of the support shaft 125 facing the free end of the pin 440 (see FIGS. 12*a* and 12*b*).

In this step, the drive roller 195 and the contrast roller 225 of the actuation device 190 are brought or kept in a distanced position (see FIG. 12*d*), so that the gap defined between them is aligned, with respect to a direction parallel to the rotation axis A of the support shaft 125, with the free end of the initial portion of the winding tape 800 that is supported by the corresponding support 455.

Simultaneously, the second return roller 260 may also be brought or kept in the disengagement position so as not to interfere with the support 455.

Figure 13D:
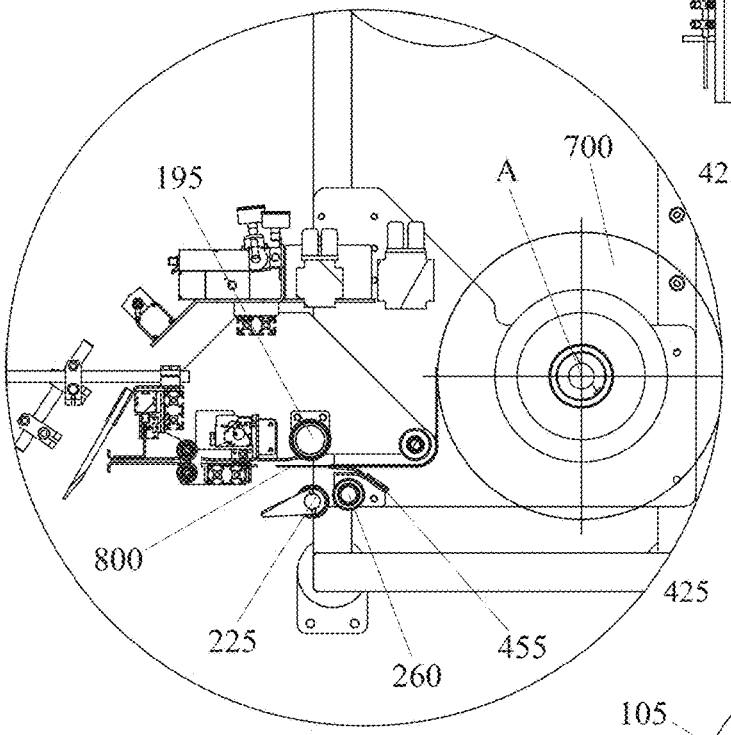
FIG. 13*d* is an enlarged detail of FIG. 12*c*.
Figure 13B:
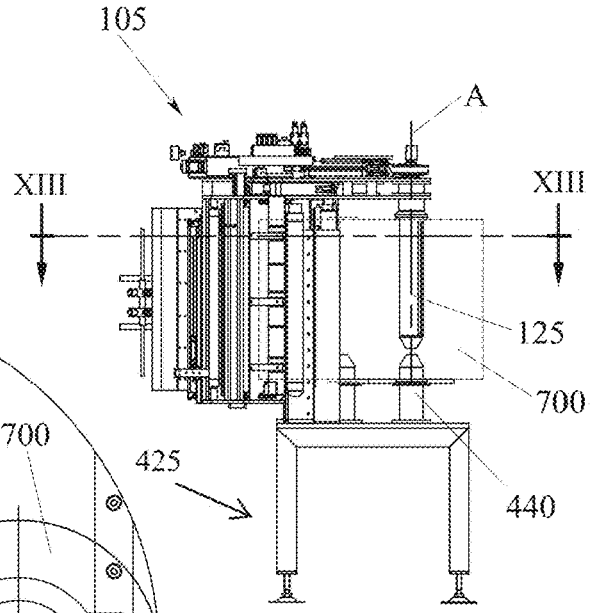
FIG. 13*b* is a side view of what is depicted in FIG. 12*a*.
Figure 13C:
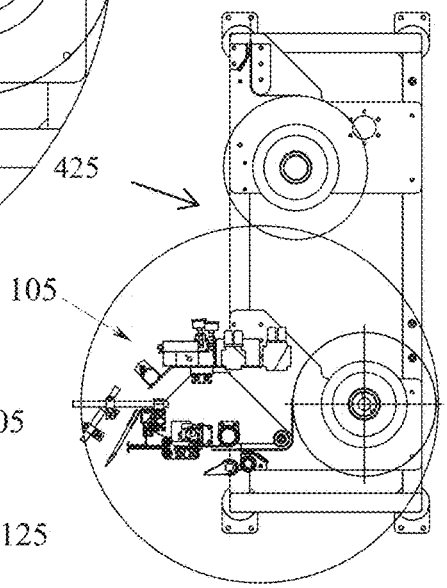
FIG. 13*c* is a plan view of what is depicted in FIG. 12*a*.
Figure 13A:
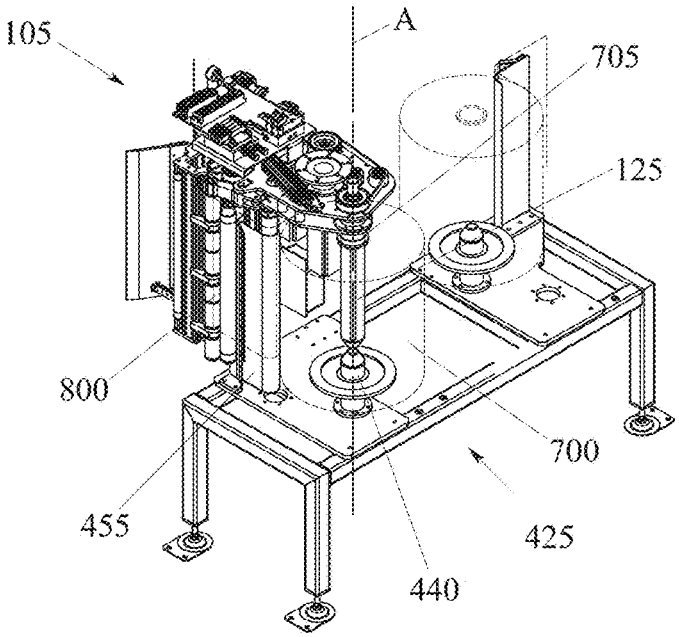
FIG. 13*a* is an axonometric view of a second step of the operation of picking up a reel from the magazine of FIG. 11 by the functional arrangement of FIG. 5.

At this point, by means of the second movement apparatus 350, the functional arrangement 105 can be made to move in a direction parallel to the rotation axis A of the support shaft 125 and approaching the pin 440 (see FIGS. 13*a*, 13*b* and 13*d*). In this way, the support shaft 125 progressively fits into the tubular support 705 of the reel 700 associated with the pin 440 and, at the same time, the free end of the initial portion of the covering tape 800 of the same reel 700, fits into the gap defined between the drive roller 195 and the contrast roller 225 of the actuation device 190.

This movement may be stopped when the support shaft 125 is fully inserted in the tubular support 705, such as when its free end is substantially in contact with or at a short distance from the free end of the pin 440, and when the initial portion of the covering tape 800 is fully inserted in the gap between the drive roller 195 and the contrast roller 225.

Figure 14D:
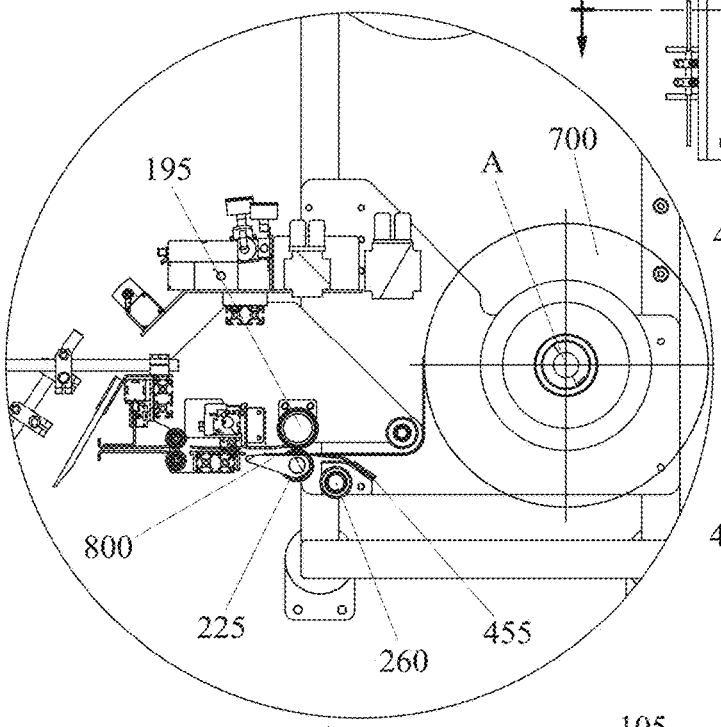
FIG. 14*d* is an enlarged detail of FIG. 12*c*.
Figure 14B:
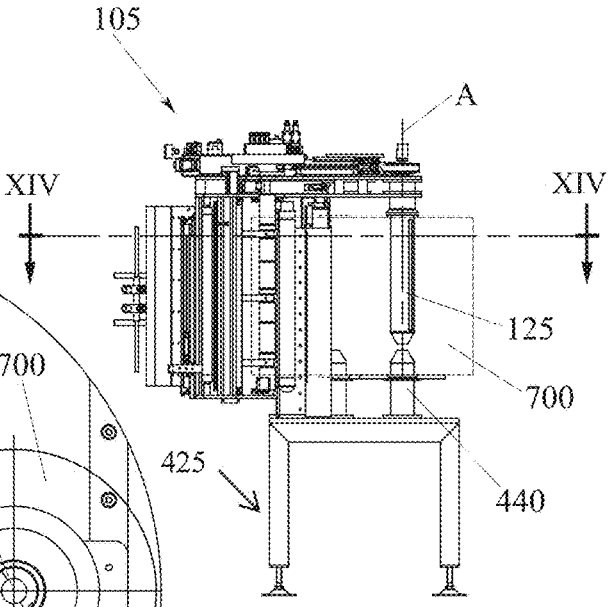
FIG. 14*b* is a side view of what is depicted in FIG. 12*a*.
Figure 14C:
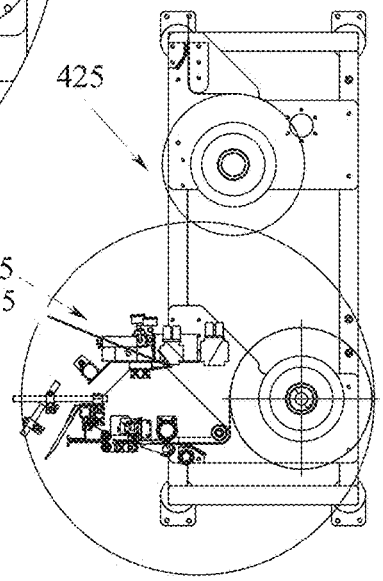
FIG. 14*c* is a plan view of what is depicted in FIG. 12*a*.
Figure 14A:
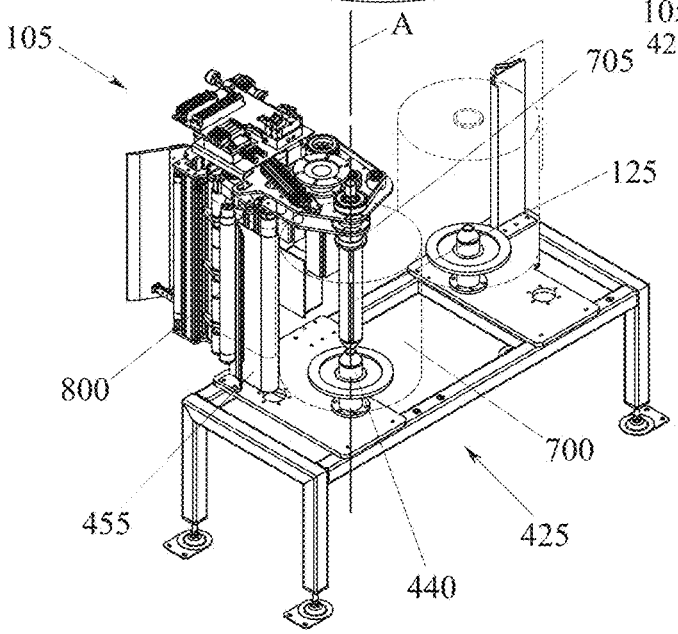
FIG. 14*a* is an axonometric view of a third step of the operation of picking up a reel from the magazine of FIG. 11 by the functional arrangement of FIG. 5.

At this point, the support shaft 125 may be brought into the maximum diameter configuration, by blocking the tubular support 705, and at the same time the drive roller 195 and the contrast roller 225 may be brought into a neared position, by blocking and retaining the initial portion of the covering tape 800 (see FIGS. 14*a*, 14*b* and 14*c*).

Figure 15D:
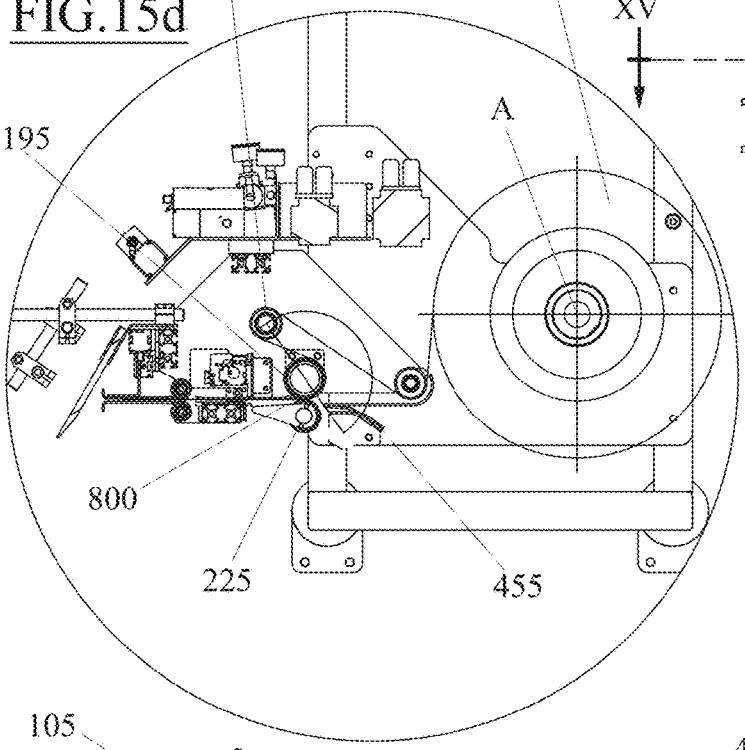
FIG. 15*d* is an enlarged detail of FIG. 12*c*.
Figure 15B:
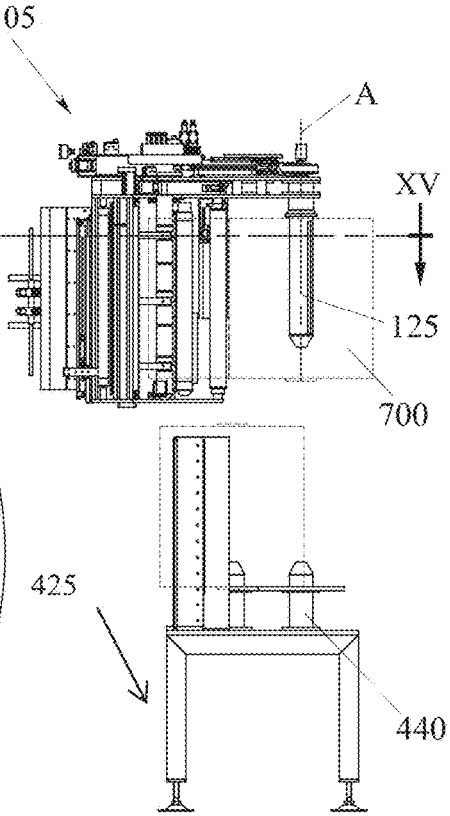
FIG. 15*b* is a side view of what is depicted in FIG. 12*a*.
Figure 15A:
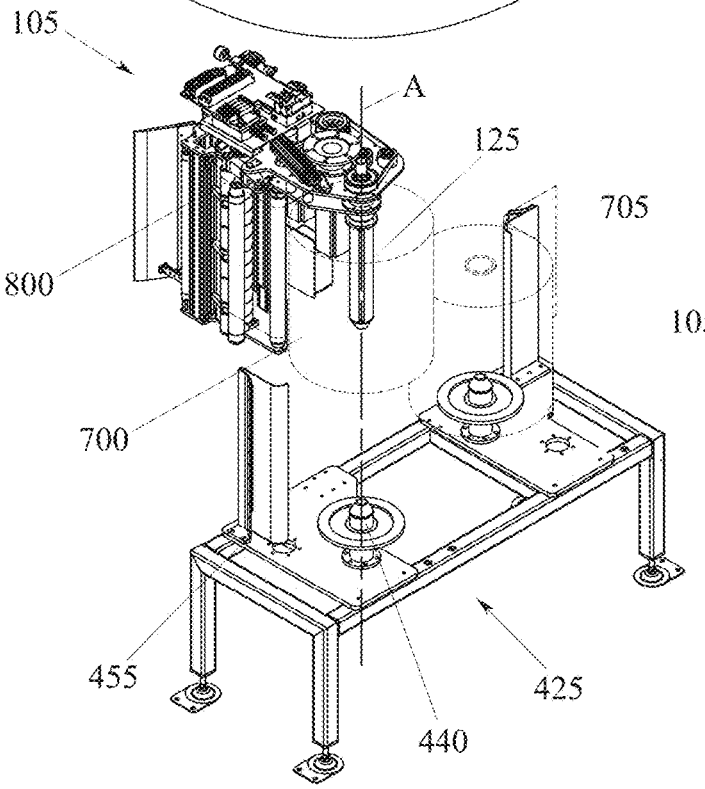
FIG. 15*a* is an axonometric view of a fourth step of the operation of picking up a reel from the magazine of FIG. 11 by the functional arrangement of FIG. 5.
Figure 15C:
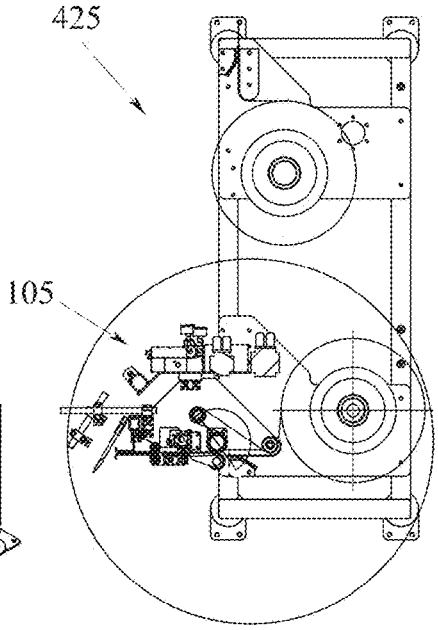
FIG. 15*c* is a plan view of what is depicted in FIG. 12*a*.

By means of the second movement apparatus 350, the functional arrangement 105 can be made to translate in the opposite direction to the previous one, moving away from the magazine 425 and at the same time removing the reel 700 and the initial portion of its covering tape 800 from the pin 440 and from the support 455, respectively (see FIGS. 15*a* and 15*b*).

Once this removal has been completed, the second return roller 260 can be brought into the engagement position (see FIG. 15*d*) and the functional arrangement 105 is ready to resume the stabilisation of the palletised loads 900.

Obviously, an expert in the field may make several technical-applicative modifications to all that above, without departing from the scope of the invention as hereinbelow claimed.

The invention claimed is:

1. A machine for stabilising palletised loads, comprising:
- a functional arrangement,
- a first movement apparatus adapted to generate a relative motion of revolution of the functional arrangement around the palletised load according to a predetermined revolution axis (Z),
- a second movement apparatus adapted to generate a relative motion of translation of the functional arrangement with respect to the palletised load in a direction parallel to the revolution axis (Z), wherein the functional arrangement comprises at least:
- a support shaft having a predetermined central axis (A) and adapted to coaxially receive a reel of a covering tape,
- a motorised drive roller having a rotation axis (b) parallel to the central axis (A) of the support shaft,
- a contrast roller having a rotation axis (C) parallel to the rotation axis (B) of the drive roller, and
- actuator members adapted to create a relative movement of said drive roller and said contrast roller in transversal direction with respect to the respective rotation axes (B, C) from a distanced configuration towards a neared configuration and vice versa from the neared configuration towards the distanced configuration,
- wherein in the distanced configuration, between the drive roller and the contrast roller, a gap is defined, adapted to be crossed with clearance by the covering tape unwinding from the reel,
- wherein in the neared configuration, the drive roller and the contrast roller are adapted to clamp said covering tape,
- wherein the support shaft and at least one of the contrast roller and the drive roller are mounted cantilevered on a structural part of the functional arrangement, so that each one of them comprises a first axial end, which is coupled to the structural part of the functional arrangement, and a second opposite axial end, which is a free end, and all of them extend from the respective first axial end to the respective second axial end in the same direction,
- wherein the functional arrangement comprises a cutting device for separating the covering tape from the reel, the drive roller and the contrast roller being operatively interposed between the support shaft and said cutting device,
- wherein the cutting device comprises at least:
  - a blade,
  - a blocking device operatively positioned between the blade and the support shaft, to selectively block the covering tape (800) unwinding from the reel, and
  - actuator members adapted to move said blade transversely with respect to the covering tape, and
- wherein said blocking device comprises a pair of plates and actuator members adapted to create a relative movement of said plates between a distanced configuration, in which the covering tape passes with clearance between said plates, and a neared configuration, in which the covering tape is tightened between said plates.

2. The machine according to claim 1, wherein the contrast roller is axially subdivided into a plurality of cylindrical sections, mutually coaxial and aligned along the rotation axis (C).

3. The machine according to claim 2, wherein said cylindrical sections are interspersed with one or more guide prongs, which are mutually parallel to and radially projecting with respect to said cylindrical sections.

4. The machine according to claim 1, wherein the drive roller is mounted on the structural part of the functional arrangement in a fixed position, the actuator members being adapted to move the contrast roller transversely with respect to the drive roller.

5. The machine according to claim 1, wherein the support shaft is a rotatable shaft adapted to rotate on the structural part of the functional arrangement around its central axis (A).

6. The machine according to claim 5, wherein the support shaft is an expandable shaft.

7. The machine according to claim 1, wherein the functional arrangement comprises:

a first return roller operatively arranged between the drive roller and the support shaft, a second return roller, mounted cantilevered on the functional arrangement, which is operatively arranged between the drive roller and the first return roller, and actuator members adapted to move the second return roller between a disengagement position, in which the axis of the second return roller is located on one side of an imaginary plane containing the rotation axis (B) of the drive roller and the axis of the first return roller, and an engagement position, in which the axis of the second re-turn roller is located on the opposite side of said imaginary plane.

8. The machine according to claim 1, further comprising:

a gripping device adapted to take a first end of the covering tape wound on the reel and to make it integral with the palletised load, and a fixing device adapted to fix at least a second end of the covering tape to the palletised load.

9. The machine according to claim 1, wherein the first movement apparatus comprises a platform, which makes a rest surface available for the palletised load, and actuator members adapted to put said platform in rotation around a rotation axis coincident with the revolution axis (Z).

10. The machine according to claim 1, wherein the second movement apparatus is configured to allow a variation in the orientation of the functional arrangement by rotation around an oscillation axis (Y) perpendicular to the revolution axis (Z).

11. The machine according to claim 10, wherein the second movement apparatus comprises:

a supporting column, a carriage slidingly associated with said supporting column in a direction parallel to the revolution axis (Z), an articulated arm with parallel axes having a first end articulated to the carriage, and an articulated joint adapted to connect the functional arrangement to the second end of the articulated arm, defining an articulation ax-is coincident with the oscillation axis (Y).

12. The machine according to claim 1, comprising a magazine adapted to accommodate at least one reel having a first end of unwound covering tape.

13. A machine for stabilising palletised loads, comprising:

a functional arrangement, a first movement apparatus adapted to generate a relative motion of revolution of the functional arrangement around the palletised load according to a predetermined revolution axis (Z), a second movement apparatus adapted to generate a relative motion of translation of the functional arrangement with respect to the palletised load in a direction parallel to the revolution axis (Z), wherein the functional arrangement comprises at least:

a support shaft having a predetermined central axis (A) and adapted to coaxially receive a reel of a covering tape, a motorised drive roller having a rotation axis (b) parallel to the central axis (A) of the support shaft, a contrast roller having a rotation axis (C) parallel to the rotation axis (B) of the drive roller, and actuator members adapted to create a relative movement of said drive roller and said contrast roller in transversal direction with respect to the respective rotation axes (B, C) from a distanced configuration, in which, between the drive roller and the contrast roller, a gap is defined, adapted to be crossed with clearance by the covering tape unwinding from the reel, and a neared configuration, in which the drive roller and the contrast roller are adapted to clamp said covering tape, wherein the support shaft and at least one of the contrast roller and the drive roller are mounted cantilevered on a structural part of the functional arrangement, so that each one of them comprises a first axial end, which is coupled to the structural part of the functional arrangement, and a second opposite axial end, which is a free end, and all of them extend from the respective first axial end to the respective second axial end in the same direction, wherein the contrast roller is axially subdivided into a plurality of cylindrical sections, mutually coaxial and aligned along the rotation axis (C), and wherein said cylindrical sections are interspersed with one or more guide prongs, which are mutually parallel to and radially projecting with respect to said cylindrical sections.

14. A machine for stabilising palletised loads, comprising:

a functional arrangement, a first movement apparatus adapted to generate a relative motion of revolution of the functional arrangement around the palletised load according to a predetermined revolution axis (Z), a second movement apparatus adapted to generate a relative motion of translation of the functional arrangement with respect to the palletised load in a direction parallel to the revolution axis (Z), wherein the functional arrangement comprises at least:

a support shaft having a predetermined central axis (A) and adapted to coaxially receive a reel of a covering tape, a motorised drive roller having a rotation axis (b) parallel to the central axis (A) of the support shaft, a contrast roller having a rotation axis (C) parallel to the rotation axis (B) of the drive roller, and actuator members adapted to create a relative movement of said drive roller and said contrast roller in transversal direction with respect to the respective rotation axes (B, C) from a distanced configuration, in which, between the drive roller and the contrast roller, a gap is defined, adapted to be crossed with clearance by the covering tape unwinding from the reel, and a neared configuration, in which the drive roller and the contrast roller are adapted to clamp said covering tape, wherein the support shaft and at least one of the contrast roller and the drive roller are mounted cantilevered on a structural part of the functional arrangement, so that each one of them comprises a first axial end, which is coupled to the structural part of the functional arrangement, and a second opposite axial end, which is a free end, and all of them extend from the respective first axial end to the respective second axial end in the same direction, and wherein the functional arrangement comprises:

a first return roller operatively arranged between the drive roller and the support shaft, a second return roller, mounted cantilevered on the functional arrangement, which is operatively arranged between the drive roller and the first return roller, and actuator members adapted to move the second return roller between a disengagement position, in which the axis of the second return roller is located on one side of an imaginary plane containing the rotation axis (B) of the drive roller and the axis of the first return roller, and an engagement position, in which the axis of the second re-turn roller is located on the opposite side of said imaginary plane.

15. A machine for stabilising palletised loads, comprising:

a functional arrangement, a first movement apparatus adapted to generate a relative motion of revolution of the functional arrangement around the palletised load according to a predetermined revolution axis (Z), a second movement apparatus adapted to generate a relative motion of translation of the functional arrangement with respect to the palletised load in a direction parallel to the revolution axis (Z), wherein the functional arrangement comprises at least:

a support shaft having a predetermined central axis (A) and adapted to coaxially receive a reel of a covering tape, a motorised drive roller having a rotation axis (b) parallel to the central axis (A) of the support shaft, a contrast roller having a rotation axis (C) parallel to the rotation axis (B) of the drive roller, and actuator members adapted to create a relative movement of said drive roller and said contrast roller in transversal direction with respect to the respective rotation axes (B, C) from a distanced configuration, in which, between the drive roller and the contrast roller, a gap is defined, adapted to be crossed with clearance by the covering tape unwinding from the reel, and a neared configuration, in which the drive roller and the contrast roller are adapted to clamp said covering tape, wherein the support shaft and at least one of the contrast roller and the drive roller are mounted cantilevered on a structural part of the functional arrangement, so that each one of them comprises a first axial end, which is coupled to the structural part of the functional arrangement, and a second opposite axial end, which is a free end, and all of them extend from the respective first axial end to the respective second axial end in the same direction, and wherein the second movement apparatus is configured to allow a variation in the orientation of the functional arrangement by rotation around an oscillation axis (Y) perpendicular to the revolution axis (Z).

16. The machine according to claim 15, wherein the second movement apparatus comprises:

a supporting column, a carriage slidingly associated with said supporting column in a direction parallel to the revolution axis (Z), an articulated arm with parallel axes having a first end articulated to the carriage, and an articulated joint adapted to connect the functional arrangement to the second end of the articulated arm, defining an articulation ax-is coincident with the oscillation axis (Y).

* * * * *